US012527347B2

(12) United States Patent
Gersznowicz

(10) Patent No.: US 12,527,347 B2
(45) **Date of Patent: *Jan. 20, 2026**

(54) SMOKING SYSTEM

(71) Applicant: Alex Gersznowicz, Kailua Kona, HI (US)

(72) Inventor: Alex Gersznowicz, Kailua Kona, HI (US)

( * ) Notice: Subject to any disclaimer, the term of this patent is extended or adjusted under 35 U.S.C. 154(b) by 958 days.

This patent is subject to a terminal disclaimer.

(21) Appl. No.: 17/580,256

(22) Filed: Jan. 20, 2022

(65) Prior Publication Data

US 2022/0142238 A1 May 12, 2022

Related U.S. Application Data

(62) Division of application No. 16/938,832, filed on Jul. 24, 2020, now Pat. No. 11,234,459.

(51) Int. Cl.

| | |
|---|---|
| ***A24F 1/30*** | (2006.01) |
| ***A24F 1/06*** | (2006.01) |
| ***A24F 1/16*** | (2006.01) |

(52) U.S. Cl.

CPC ..... *A24F 1/16* (2013.01); *A24F 1/06* (2013.01); *A24F 1/30* (2013.01)

(58) Field of Classification Search

CPC ..... A24F 1/30
USPC ..... 131/173
See application file for complete search history.

(56) References Cited

U.S. PATENT DOCUMENTS

| | | | |
|---|---|---|---|
| 809,325 | A | 1/1906 | Probyn |
| 848,424 | A | 3/1907 | Abizaid |
| 1,563,460 | A | 12/1925 | Walker |
| 1,967,438 | A | 7/1934 | Evans |
| 2,190,312 | A | 2/1940 | Cullen |
| 2,815,030 | A | 12/1957 | Wenger |
| 3,918,464 | A | 11/1975 | Kolodziej |
| 4,029,109 | A | 6/1977 | Kahler |
| 4,071,035 | A | 1/1978 | Boyd et al. |
| D249,711 | S | 9/1978 | Flesher |
| 4,111,213 | A | 9/1978 | Shanto et al. |
| 4,142,536 | A | 3/1979 | DeCarlo |
| 4,148,327 | A | 4/1979 | Graham |
| 11,234,459 | B1 | 2/2022 | Gersznowicz |
| 2017/0245546 | A1 | 8/2017 | Huang |

(Continued)

FOREIGN PATENT DOCUMENTS

| | | | |
|---|---|---|---|
| CA | 2276914 | A1 | 1/2001 |
| CN | 2060982 | U | 8/1990 |
| CN | 203860444 | U | 10/2014 |

OTHER PUBLICATIONS

Espacenet Mechanical English Translation of CN2060982 ; https://translationportal.epo.org/emtp/translate/?ACTION=description-retrieval&COUNTRY=CN&ENGINE=google&FORMAT=docdb&KIND=U&LOCALE=en_EP&NUMBER=2060982&OPS=ops.epo.org/3.2&SRCLANG=zh&TRGLANG=en, printed from the Internet on Feb. 25, 2025. (Year: 1990).*

*Primary Examiner* — Dionne W. Mayes
(74) *Attorney, Agent, or Firm* — Shay Glenn LLP

(57) ABSTRACT

Described herein are devices, systems, and methods for use during smoking. The systems may include a plurality of pipes or chambers for holding fluid and smoke and a plurality of smoke conduits connecting the chambers to form a continuous flow path for smoke. These techniques may be particularly useful, for example, for cooling and cleaning smoke prior to a user inhaling the smoke and may make a smoking safer and a more pleasurable experience for the user.

20 Claims, 23 Drawing Sheets

(56) References Cited

U.S. PATENT DOCUMENTS

| | | | |
|---|---|---|---|
| 2018/0103683 | A1 | 4/2018 | Parker |
| 2018/0177226 | A1 | 6/2018 | Royse, IV |

* cited by examiner

SMOKING SYSTEM

CROSS-REFERENCE TO RELATED APPLICATIONS

This application is a division of U.S. application Ser. No. 16/938,832, filed Jul. 24, 2020, now U.S. Pat. No. 11,234,459, incorporated by reference as if fully set forth herein.

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

Described herein are devices, systems, and methods for use for smoking. These techniques may be particularly useful for cooling, cleaning, and smoothing smoke prior to a user inhaling the smoke and may make the smoking experience safer and more pleasurable for the user. The devices and systems may be especially easy to clean or sanitize.

BACKGROUND

People have smoked plain and flavored tobaccos, herbal plants, *cannabis*, and/or spices for thousands of years for a variety of reasons including for pleasure and religious, social, or health reasons. Although used by many people, the smoking process generates airborne particulate matter and other debris from the smoked plants that can be dangerous and airborne particulate matter is one of the biggest health threats from smoking. Contact with smoke, and in particular with particulates in the smoke, can cause watery and red, burning eyes. When inhaled, particulates can get into the nasal passages and deep into the lungs of a person and cause runny noses, bronchitis, cough, lung disease, heart disease, and a weakened immune system.

Despite generations of people having smoked, existing smoking devices can be large, unsanitary, inefficient at removing particulates or other contaminants, and/or inefficient at consistently cooling smoke to a comfortable inhalation temperature. Additionally, existing smoking devices can be cumbersome to clean and difficult to sanitize. Accordingly, there is a need for improved devices for smoking that clean and cool smoke for smoking and are easy to clean and sanitize. Described herein are improved devices and methods that may meet these or other needs.

SUMMARY OF THE DISCLOSURE

The present invention relates to devices, systems, and methods for use for smoking. These techniques may be particularly useful for cooling, cleaning, and smoothing smoke prior to a user inhaling the smoke and may make the smoking experience safer and more pleasurable for the user. The devices and systems may be especially easy to clean or sanitize.

One aspect of the disclosure provides a system for smoking, the system including: a body including: a plurality of pipes with open tops and an open bottoms and configured to accept smoke and a fluid, a conduit connecting an upper portion of a chamber in one of the pipes to a lower portion of a chamber in a second of the pipes, the conduit configured to pass smoke therethrough, a smoke inlet port in a first of the chambers at a first end of a continuous flow path, and a smoke outlet port in a last of the chambers at a second end of the continuous flow path. Some embodiments include a disengageable base configured to engage with and disengage from the bottoms of the plurality of pipes at the bottom of the body. Some embodiments include a disengageable cover configured to engage with and disengage from the tops of the plurality of pipes at the top of the body.

In some embodiments the plurality of pipes are arranged around a central axis.

In some embodiments the plurality of pipes includes at least three pipes.

In some embodiments the disengageable cover includes a recess to connect the conduit to the upper portion of one of the pipes.

In some embodiments disengageable cover is configured to sealingly engage with a top of the body and form an airtight seal with the tops of the pipes and the disengageable base is configured to sealingly engage with a bottom of the body and form a watertight seal with the bottoms of the pipes.

Some embodiments further include a fastener extending between the base and the cover and configured to reversibly hold the base and cover on the body.

Some embodiments further include a second conduit in the continuous flow path connecting an upper portion of the second chamber to a lower portion of a third chamber, wherein the conduits comprise stiff walls.

In some embodiments each of the plurality of chambers has a height of at least 4 inches.

In some embodiments the plurality of chambers are each configured to hold a fluid at least 2 inches in height and together to hold fluid at least 8 inches in height during system use.

In some embodiments the plurality of chambers are nested.

Another aspect of the disclosure provides system for smoking, the system including: a body including: a plurality of pipes for holding fluid and smoke, the pipes having a top, a bottom, and a chamber therebetween, the pipes arranged around a central axis; a plurality of smoke conduits each connecting an upper portion of one of the chambers to a lower portion of another of the chambers, the plurality of smoke conduits configured to pass smoke therethrough, the chambers and conduits configured to form a continuous flow path; a smoke inlet port in a first of the chambers at a first end of continuous flow path; and a smoke outlet port in a last of the chambers at a second end of the continuous flow path.

In some embodiments, the plurality of chambers includes at least three chambers.

Some embodiments further include a disengageable base at a first end of the body and configured to engage and disengage from the bottoms of the plurality of pipes. Some embodiments further include a disengageable cover at a second end of the body and configured to engage and disengage from the tops of the plurality of pipes.

In some embodiments, the disengageable cover comprises a plurality of recesses to connect each conduit to the upper portion of one of the pipes.

Some embodiments further include wherein each of the plurality of chambers has a height of at least 4 inches. In some embodiments, the plurality of chambers are each configured to hold a fluid at least 2 inches in height and together to hold fluid at least 8 inches in height during system use.

Another aspect of the disclosure provides a method of using a system for smoking including: generating smoke; creating a negative pressure in a body of a smoking system, the body including at least pipes each having a chamber containing fluid; drawing, using the negative pressure, the smoke into the body through a smoke inlet port; passing the smoke through three separate pools of fluid in the body, the separate pools in three separate pipes; and removing the smoke from the body at a smoke outlet port.

Some embodiments further include the step of attaching a disengageable base to the bottom of the pipes. Some embodiments further include the step placing a fluid in the three chambers before the creating a negative pressure step.

In some embodiments the passing step includes passing the smoke through at least three chambers each containing one of the at least three separate pools of fluid and through at least two conduits comprising stiff walls, the conduits connecting upper and lower portions of different chambers of the plurality of chambers and configured to pass smoke therethrough.

Some embodiments further include the step of disengaging a disengageable base and a disengageable cover from the body to thereby open the bottom and top ends of the pipes, respectively, and passing a cleaning solution into one end of the pipes and conduits and out the other end of the chambers and conduits.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1:
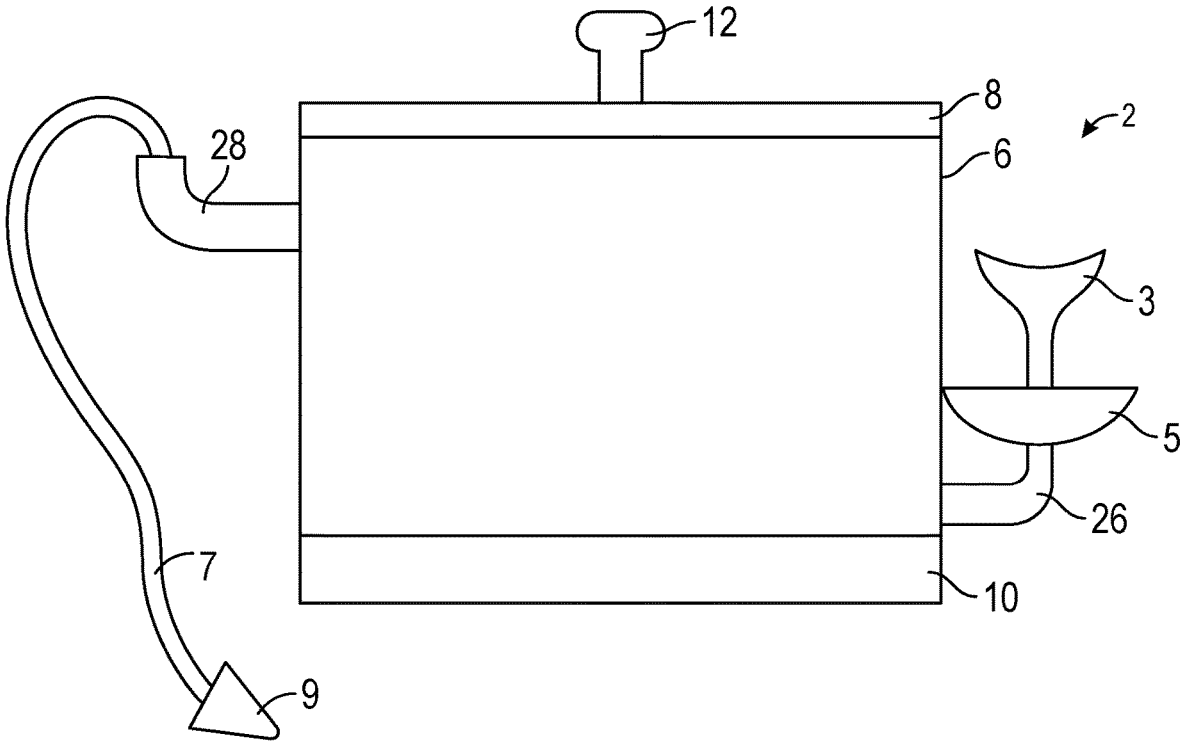
FIG. 1 shows a diagram of a smoking system as described herein.

Described herein are devices, systems, and methods for use for generating smoke from a substance, such as from tobacco, *cannabis*, herbs, spices, or another plant. These techniques may be particularly useful for cooling and cleaning smoke prior to a user inhaling the smoke and may make smoking safer and more pleasurable for the user. The devices and systems may be configured for easy cleaning so they can be used long-term in a sanitary manner. The devices and systems can pass smoke through multiple pools (e.g., 2, 3, 4, 5, 6 or more) of a fluid such as water, to clean and cool the smoke and then the parts of the system can be disengaged from one another for easy cleaning such as by hand or in a household kitchen dishwasher. Smoking systems as described herein can have a body with a plurality of pipes having a plurality of chambers, a plurality of conduits connecting the chambers, a base and a cover. The systems may also include or be configured to include one or more bowls or ash catchers for smoking a substance and one or more hoses or mouthpieces for a smoker to inhale through. The plurality of chambers and plurality of conduits may be configured for holding fluid and smoke and together to form a flow path so that smoke can flow between the chambers and conduits from one end of the flow path to another end. FIG. 1 shows a smoking system 2 as described herein with a plurality of chambers and a body 6, cover 8, base 10. FIG. 1 also shows the smoking system 2 with a bowl 3, ash catcher 5, hose 7, and mouthpiece 9.

Figure 2:
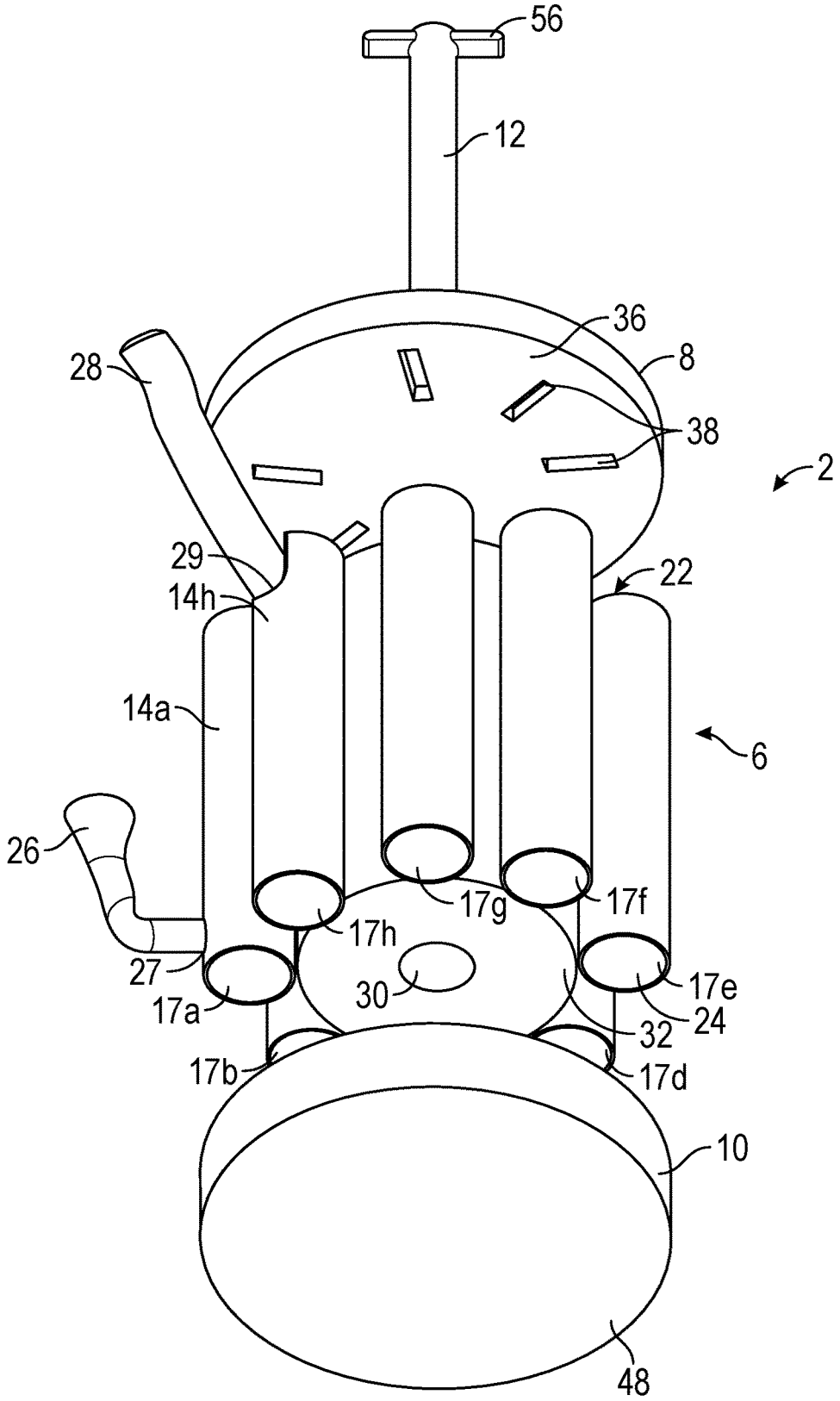
FIG. 2 shows a side-bottom perspective view of a smoking system as described herein.

FIG. 2 shows a side-bottom perspective view of a smoking system 2 that is partially disassembled. FIG. 2 shows the smoking system 2 has a body 6, a cover 8, a base 10, and a fastener 12. The cover 8, base 10, and fastener 12 are disengaged from the body 6 in this view.

The body 6 of smoking system 2 has a plurality of pipes 14 (which may sometimes be individually referred to herein as pipes 14*a*-14*h*). The pipes 14 are open at the bottom at a bottom opening 24 (which may sometimes be individually referred to herein as bottom openings 24*a*-24*h*) and open at the top with a top opening 22 (which may sometimes be individually referred to herein as top openings 22*a*-22*h*). Pipes 14 are configured to hold a fluid and smoke particularly when the cover 8 and base 10 are in place over the bottom openings 24 and top openings 22. Pipes 14 (conduits, recesses, and/or other parts of the system) may be composed of or be lined with a fluid tolerant and smoke tolerant material such as acrylic, glass, metal, ceramic, plastic, rubber, or another thermoplastic material. In some particular examples, pipes, conduits, recesses, and/or other parts of the system can be stiff. As explained in more detail below, stiff materials may facilitate cleaning as cleaning solution can readily pass through a stiff pipe or conduit. The materials can be solid, opaque, translucent or transparent. FIG. 2 shows the pipes 14 as cylinders with a circular cross-section around a central cylindrical opening; however, the pipes and central cylindrical opening do not need to be cylindrical. Pipes and the central cylindrical opening in a body of a smoking device, such as pipes 14, can be elongate and have a non-circular cross-section such as an ovoid, square, or rectangular cross-section. The shape of the pipes can be constant or can be not constant (can vary) along the tube height such as for artistic preference. The pipes 14 may be straight or not straight (e.g., curved). Some or all of the pipes in a device can have identical shapes or they can have different shapes. Although straight pipes may sometimes be easier to manufacture or to clean, curved tubes may provide an aesthetic appeal. A body may have at least 2 pipes, at least 3 pipes, at least 4 pipes, at least 5 pipes, at least 6 pipes, or not more than 8 pipes, not more than 7 pipes, not more than 6 pipes, not more than 5 pipes, not more than 4 pipes, not more than 3 pipes, or not more than 2 pipes. A body may have any number of pipes between these numbers such as from 3 to 6 tubes. A tube may be configured (sized and shaped) to balance various factors, such as smoke cooling capacity, smoke cleaning capacity, ease of device cleaning, the number of tubes that fit into a desired size (e.g., that can be handheld), manufacturability, and aesthetic appeal. A pipe may be at least one inch in height, at least two inches, at least three inches, at least four inches, at least five inches, at least six inches, at least seven inches, at least eight inches, less than eight inches, less than seven inches, less than six inches, less than five inches, less than four inches, less than three inches, or less than two inches in height. A pipe may have a height between any of these amounts such as at least one inch and less than eight inches, or at least two inches. A plurality of tubes in a body may have the same height. In some variations, tubes in a body may have different heights. For example, the tubes can be "stepped" relative to one another with one or more tubes longer than another tube. A plurality of stepped tubes can be interconnected by conduits as described herein connecting a top of one tube to a bottom of another tube to form a continuous flow path. A base and/or cover can also be "stepped" or uneven to accommodate the tubes. A stepped base and/or cover may seal the bottom and/or top or the pipes. In some variations, a plurality of tubes can be about the same height but arranged in a stepped fashion. A plurality of stepped tubes can be interconnected by conduits as described herein connecting a top of one tube to a bottom of another tube to form a continuous flow path. A pipe may be from 0.1 inches to 5 inches in diameter or width. In some examples, a tube may be from 0.5 inches to 2 inches in diameter or width. The pipes (plurality of pipes) in a body may have the same size diameter or width or have different diameters or widths. For example, a body may have at least three tubes each with at least ½ inch diameter. In some variations, one tube may have a bigger diameter or width than other tubes. For example, a body may have a tube (e.g., a first tube) with a bigger (e.g., 2 inch) diameter connected with two more tubes in the flow path having smaller (e.g., 1 inch) diameters. FIG. 2 also shows pipes 14 arranged around and attached to frame 32. Frame 32 is shown as a cylinder with a central cylindrical opening but does not need to be. In some variations, the pipes 14 and the frame 32 can be integrally formed. In some variations, the body 6 may not have a separate frame. For example, pipes 14 could be attached to each other. Frame 32 includes a center opening 30. Center opening 30 provides space for fastener 12 to extend from the cover 8 to the base 10 and hold the smoking system together (e.g., hold the cover, body, and base together).

FIG. 2 also shows pipe 14*a* has a smoke inlet port 27 and a smoke entrance pipe 26 is attached to smoke inlet port 27. Smoke entrance pipe 26 can be integral with the pipe 14*a* or can be separate and placed onto pipe 14*a* for use. FIG. 2 also shows pipe 14*h* has a smoke outlet port 29 and a smoke exit pipe 28 is attached to smoke outlet port 29. Smoke entrance pipe 26 can be integral with the pipe 14*a* and smoke exit pipe 28 can be with integral with pipe 14*h* or they can be separate and placed onto pipe 14*a* and pipe 14*h*, respectively, for use, such as by forming a ground glass joint. As indicated above, a smoking device as described herein may be configured with a varying number of pipes (or sleeves though will be referred to here as pipes for clarity) and a smoke inlet port 27 can be on a "first" pipe of a continuous flow path and a smoke outlet port 29 can be on a "last" pipe of a continuous flow path, regardless of how many intervening pipes a smoking device may have between the "first" and "last" pipes. For example, a smoking device may have no, 1, 2, 3, 4, 5, or 6 or more intervening pipes (and associated conduits and related features) between the first and last pipes. For example, a smoking system with smaller or shorter pipes may have relatively more tubes and a smoking system with larger or longer tubes may have relatively fewer pipes achieve desired smoking cleaning, cooling, or smoothing levels. This and other systems described herein may have a smaller number of pipes so that drawing on the smoking device is easier. The various pipes remove different amounts of particulates or other unwanted matter. The first pipe may remove more particulates than the second pipe and the second pipe may remove more particulates than the third pipe and so on. FIG. 2 also shows pipes 14 are arranged around a central or longitudinal axis. FIG. 2 also shows base 10 has a bottom side 48. This and any bottom side of a system be configured for sitting on a surface, such as an indoor or outdoor surface, such as a table, counter, floor, or yard. Bottom side 48 may be weighted or not weighted to aid in system balance. Bottom side 48 may be flat or not flat. Bottom side 48 of base 10 may have a smooth surface or a grippy surface. A grippy surface of bottom side 48 of base 10 may have texture or roughness such as a cut-out texture or a sandpaper-like surface and may keep the smoking system from sliding or tipping over. The bottom side 48 may be silicone, rubber or another grippy material. When the body 6 is attached to base 10, they can sit together on a surface without unwanted sliding or tipping over. A bottom side 48 of base 10 may be smooth so that the system can be easily slid without sticking. In some variations, a base can have two or more halves or other parts. For example, a base and/or cover could have two semicircular halves and open like a pair of trap doors facing one another and other variations are possible as well.

FIG. 2 also shows cover 8 with a plurality of recesses 38 in the bottom side 36 of the cover 8. The recesses 38 are arranged to partially overlay or overhang the pipes 14 when the cover 8 abuts the top of body 6. The recesses 38 are also arranged to partially overlay or overhang the conduits 54 (not seen in this view; see FIG. 3 and FIG. 5) when the cover 8 abuts the top of body 6). One recess 38 corresponds with a pipe and conduit (e.g. connects one pipe and one conduit). When the cover 8 abuts the top of the body 6 (and top of the pipes 14), the recesses 38 are part of a flow path between the top of the pipes 14 and the top of the conduits. The recesses 38 are part of a continuous flow path from a first end to a second end of the smoking system 2. The top part of cover 8 may form a closed roof over the recesses 38. A recess may be a (rounded) rectangular prism, (rounded) triangular prism, or a cylindrical shape and may have flat or rounded surfaces. A recess may be longer than it is wide so that it encompasses both the pipes 14 and conduits 54, such as shown in FIG. 2, but it does not need to be. A recess may be, for example from 0.2 inches to 3 inches in a given dimension. For example, a recess may be 0.2 inches to 2 inches long, 0.2 inches to 1 inch wide, and 0.2 inches to 1 inch deep for a handheld smoking system. The recesses can be open along substantially the bottom side (the side facing the pipes and conduit) to facilitate the flow of smoke from the conduits to the pipes as shown though other configurations are possible. For example, a recess could be a tube with open ends connecting the top of pipes 14 and conduits 54. The recesses 38 can, for example, be added to or cut or etched into the cover 8 or can be formed during additive manufacturing (e.g., 3D printing). In some variations, the recesses can be ports in the body connecting the pipes 14 and conduits 54.

Figure 3:
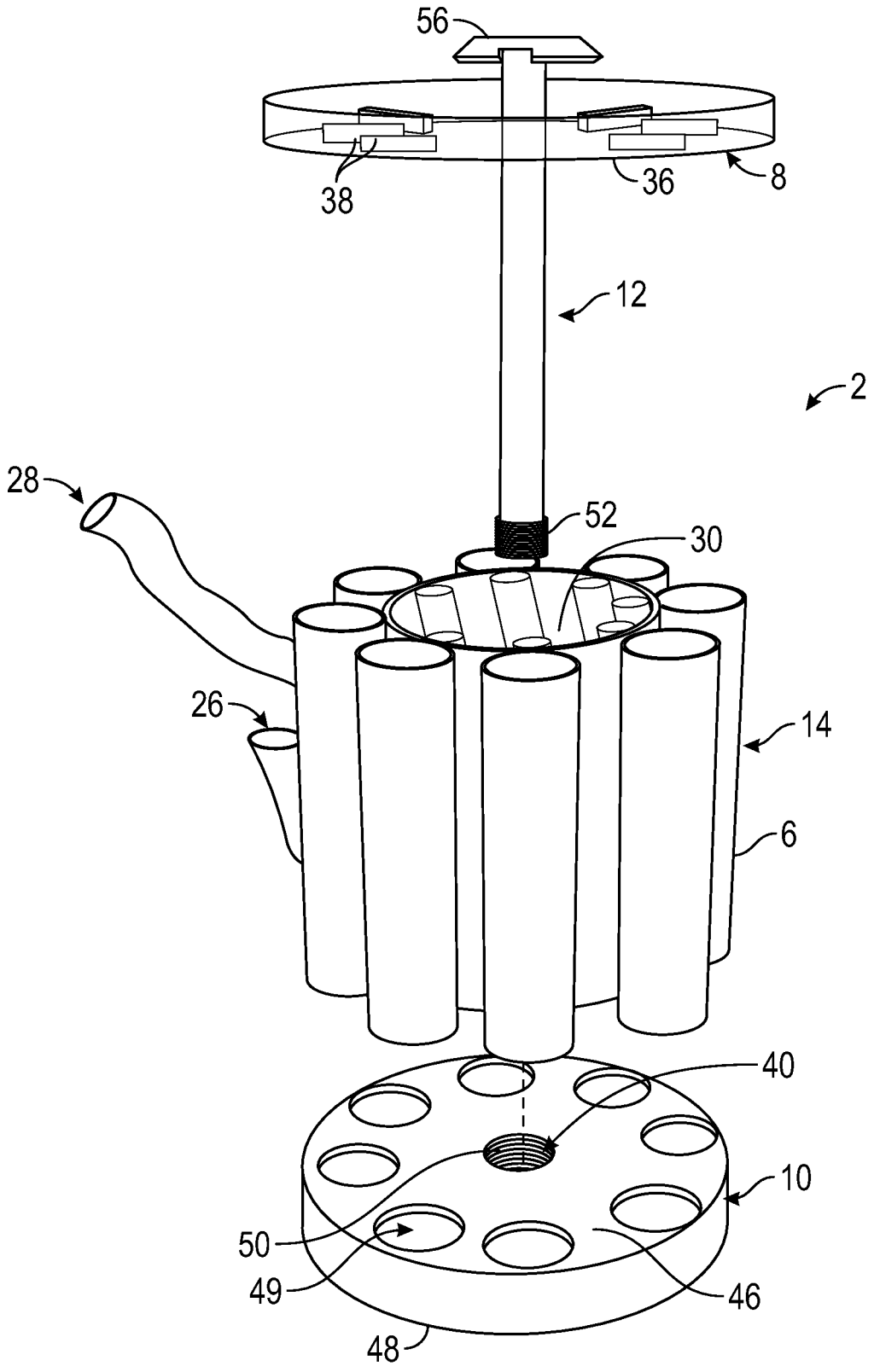
FIG. 3 shows a partially exploded view of the smoking system shown in FIG. 2.
Figure 7:
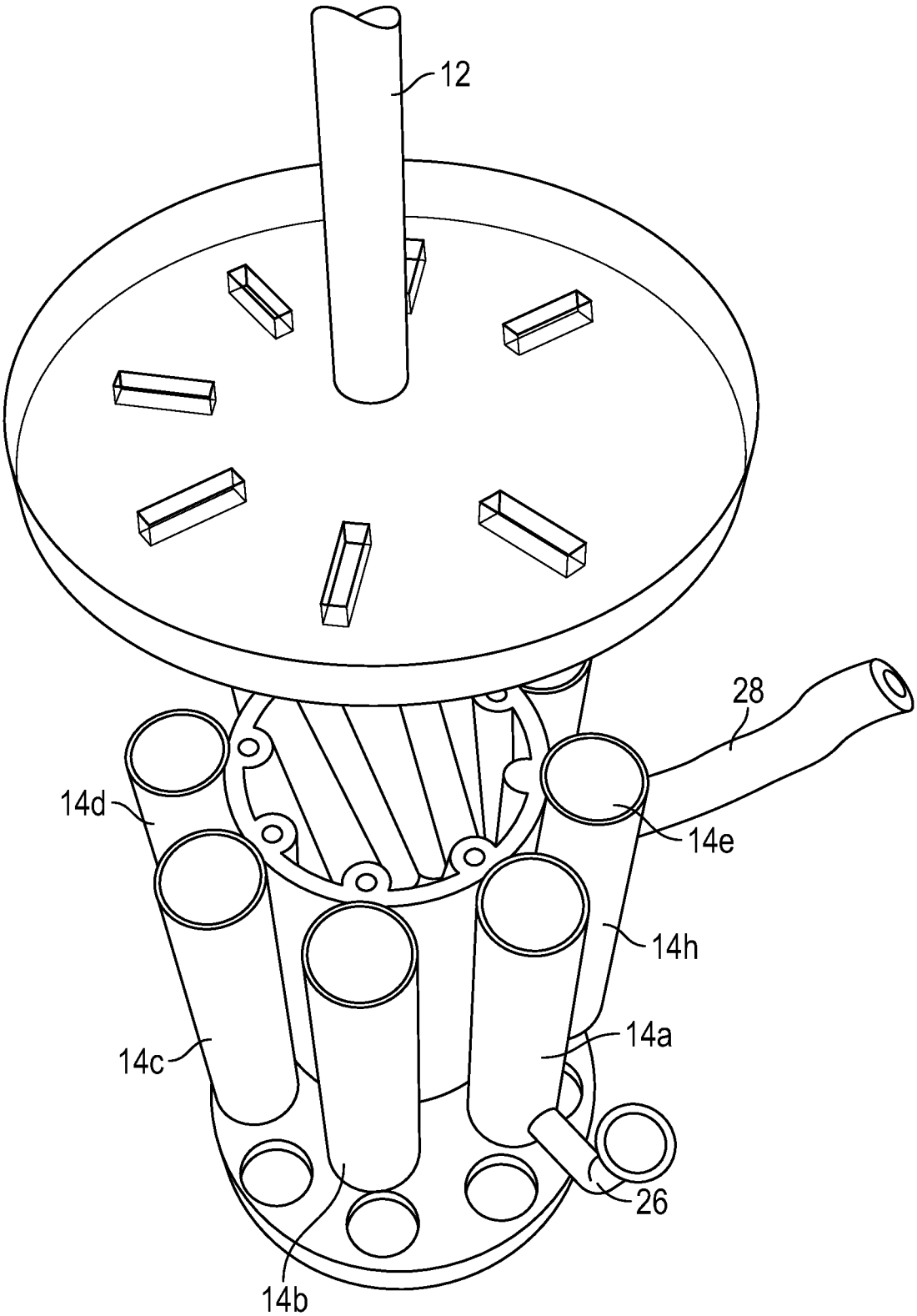
FIG. 7 shows another top-side perspective view of the smoking system shown in FIG. 4 with the cover removed.

FIG. 3 (and see also FIG. 7) shows a partially exploded view of the smoking system shown in FIG. 2. FIG. 3 shows the top side 46 of base 10 with a plurality of cavities 49 and a hollow 40 lined with threads 50. Cavities 49 are configured to receive the bottom part of the pipes 14. The cavities 49 and pipes 14 form a fluid tight (watertight) and airtight connection. The cavities 49 and pipes 14 may form a fluid tight (watertight) and airtight connection when the bottom part of body 6 is placed on the top side 46 of the base 10, with the bottom of pipes 14 lined up with the cavities 49 and the body 6 and base 10 are held together by a fastener, such as fastener 12. FIG. 3 shows body 6 and base 10 that can be held together using fastener 12, such as by using mating threads between a screw fastener 12 and the hollow 40. Fastener 12 can be extended through the central cylindrical opening of the body 6 and into the hollow 40. Upon turning the fastener 12 (e.g., turning clockwise), the threads 52 can be screwed into mating threads 40 to hold the system together and hold the bottom of pipes 14 against the base 10. The base 10, cavities 49, top side 46 of base 10, cover 8, bottom side 36 of cover 8, and/or recesses 38, the top or bottom parts of the pipes 14 can be made from, lined with, or coated with one or more fluid and/or smoke resistant materials, such as ethylene-propylene, fluorosilicone, nitrile, neoprene, polytetrafluoroethylene (PTFE), rubber, silicone, or Teflon™ to aid in sealing. The material may be pliable or compliant for seating and sealing the bottoms of pipes 14 to the cavities 49 and/or the tops of pipes 14 to the recesses 38 and cover 8. A cavity can be or have a gasket or O-ring, such as a gasket or O-ring made with one of these materials. In some variations, the base 10 does not have cavities and/or the cover 8 does not have recesses. For example, the base 10 could have protrusions or plugs configured to partially enter the bottom openings of the pipes 14 and reversibly seal and unseal the openings of the pipes 14. In some variations, the body 6 and base 10 could be held together using another fastener, such as magnets or a hasp latch. In some variations, the fastener 12 and the base 10 (e.g., the hollow 40 in the base) can be held together using a friction fit, hooks, a mated-fit, magnets (magnetic snaps) or a snap-fit. In some variations, two or more than two fasteners can be used. One or more fasteners can extend through the center of the body 6 or extend elsewhere through or outside the body, such as along the outer perimeter of the body. In some variations, a smoking system 2 can have separate cover and base fasteners. A smoking system 2 could also include one or more hinges or tethers between the base 10 and the body 6, between the cover 8 and the base 10 and/or between the fastener and the body 6, base 10, and/or cover 8. Hinges or other tethers could hold the base and body together even when the base and body are disengaged from each other, such as for cleaning. Hinges or other tethers could keep parts of the smoking system 2 from being misplaced or lost.

Figure 4:
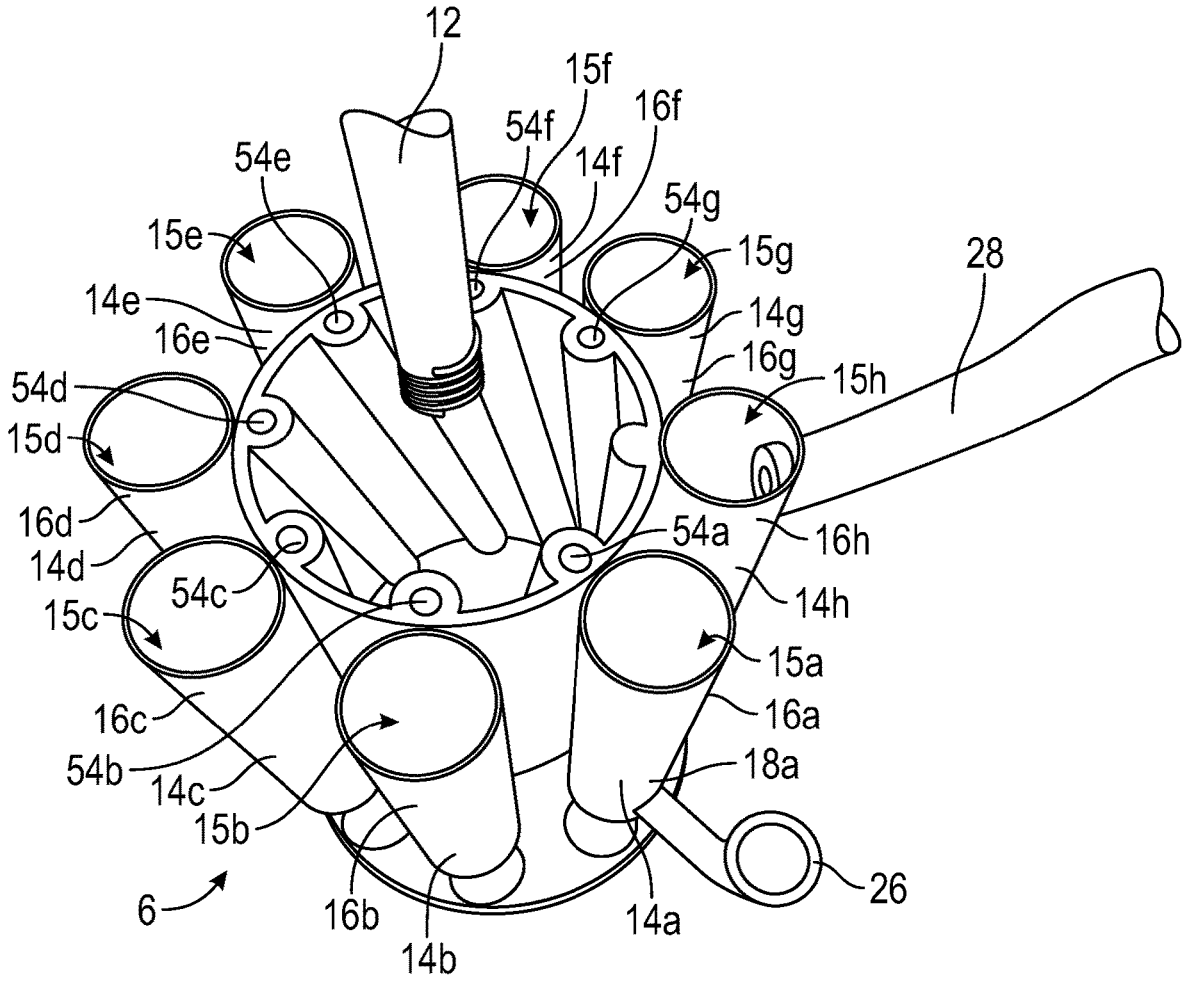
FIG. 4 shows a top perspective view of the smoking system shown in FIG. 3 without a cover.
Figure 5:
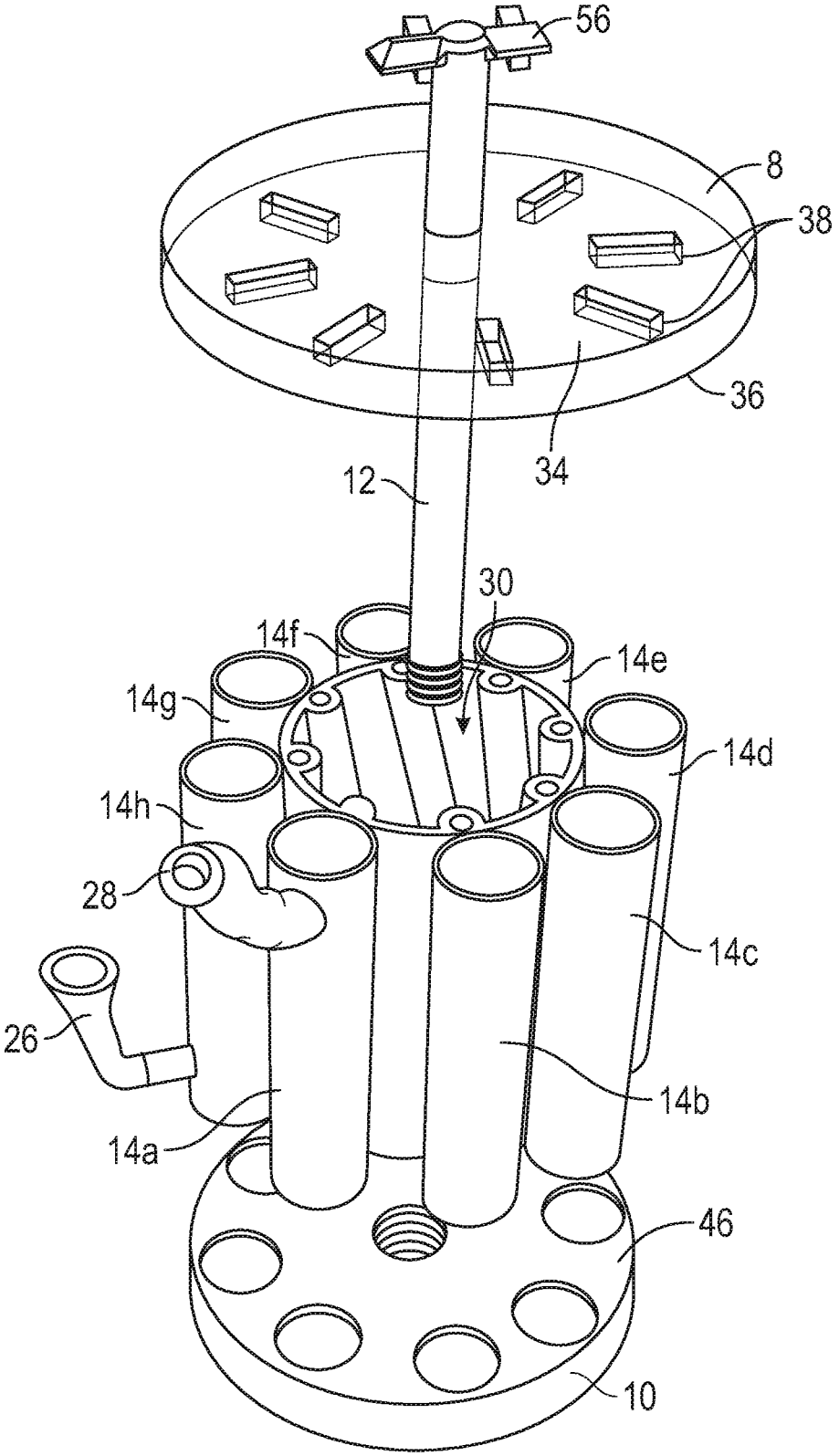
FIG. 5 shows a top-side perspective view of the smoking system shown in FIG. 4 with the cover removed.
Figure 6A:
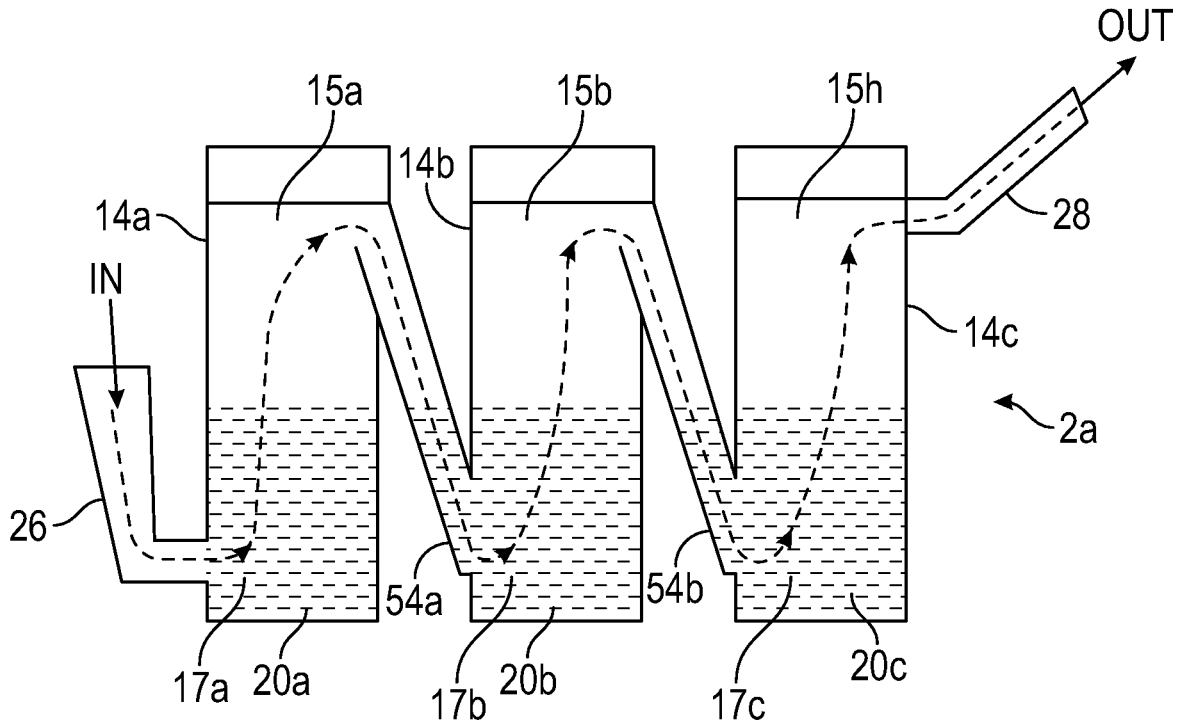
FIG. 6A shows how smoke can flow through multiple smoking chambers of a system with a disengageable base and cover.

FIG. 4 shows a top perspective view of the smoking system shown in FIG. 3 without the cover and FIG. 5 shows a top-side perspective view of the smoking system shown in FIG. 4 with the cover removed from the body. FIG. 6A shows a variation of the smoking system 2 shown in FIG. 2-FIG. 5, smoking system 2*a*. Smoking system 2*a* in FIG. 6A is similar to smoking system 2 except that it has just three pipes rather than eight (and only three sets of other elements associated with the pipes such as conduits or recesses) and is expanded to better show the flow path through the system. FIG. 4 shows the body 6 with a plurality of smoke conduits 54 (which may sometimes be individually referred to herein as smoke conduits 54*a*-54*g*). The smoke conduits 54 each connect upper and lower portions of different pipes 14/chambers 15. The smoke conduits 54 are configured to pass smoke therethrough and in particular to pass smoke from the top of one pipe to the bottom of a different pipe (e.g., into a fluid pool at the bottom of a different pipe). By way of example, smoke conduit 54*a* connects the upper portion 15*a* of the chamber in the pipe 14*a* (see FIG. 6A) with the lower portion 17*b* of the chamber in pipe 14*b*, the next pipe in the flow path. Smoke conduit 54*b* connects the upper portion 15*b* of the chamber in the pipe 14*b* with the lower portion 18*c* in pipe 14*c*, the next pipe in the flow path. In FIG. 2-FIG. 5, the flow path continues similarly through the other pipes and conduits to the last pipe 14*h* in the flow path which has the smoke exit pipe 28. As indicated above, FIG. 6A shows only three pipes and the third and last pipe in the flow path, pipe 15*c*, contains smoke exit pipe 28. As shown in FIG. 4 and FIG. 5 and best seen in FIG. 6A, a smoking system can have one fewer smoke conduits (n−1 smoke conduits) than it has pipes (n pipes) where n represents the number of pipes in a smoking system. Thus, intervening pipes between the first and last pipes, such as pipe 15*b* in FIG. 6A, is connected to two smoke conduits each connected to different pipes. Other pipes, such as first pipe 15*a* in FIG. 6A is connected to one smoke conduit (smoke conduit 54*a*) and is also connected to a smoke entrance pipe (smoke entrance pipe 26). Other pipes, such as last pipe 15*h* in FIG. 4 and last pipe 15*c* in FIG. 6A, connect to one smoke conduit (smoke conduit 54*b* in FIG. 6A) and to a smoke exit pipe (smoke exit pipe 28). FIG. 6A shows smoking system 2*a* has a continuous flow path for smoke from the smoke inlet IN to the smoke outlet OUT, shown by the arrowed pathway in FIG. 6A. Smoke is deposited at entrance pipe 26, flows into the water pool 20*a* chamber and through water 20*a*. From there, it flows into upper chamber 15*a*, through conduit 54*a* and into the second chamber and into water 20*b*. From there, it flows into upper chamber 15*b*, through conduit 54*b* and into the third chamber and into water 20*c*. From there, it flows into upper chamber 15*c* and is removed from chamber 15*c* (15*h* in system 2) through smoke exit pipe 28. In use, a negative pressure or vacuum is placed on the smoking system, such as through smoke exit pipe 28 by a user placing their mouth around a mouthpiece 9 connected to the smoke exit pipe 28 by a hose 7 and inhaling through the mouthpiece 9. The negative pressure or vacuum created by the user creates a negative pressure, removing smoke (or air) from the chamber 15*c* (15*h* in smoking system 2) and creates a negative pressure or vacuum through the smoking system, drawing smoke from the smoke entrance pipe 26 successively through the pipes, fluid pools, and conduits. As the smoke passes successively through the pools of fluid, the fluid is cleaning and cooling the smoke. Some of the particulates and other debris from the smoke is left behind in each of the fluid pools as the smoke rises up and out of the fluid and into the top part of each chamber. The smoke rising out from successive fluid pools is cleaner than the smoke that entered it; thus, each pipe/chamber/fluid pool in a flow path can improve the quality of the smoke relative to the previous pipe/chamber/fluid pool.

Figure 6B:
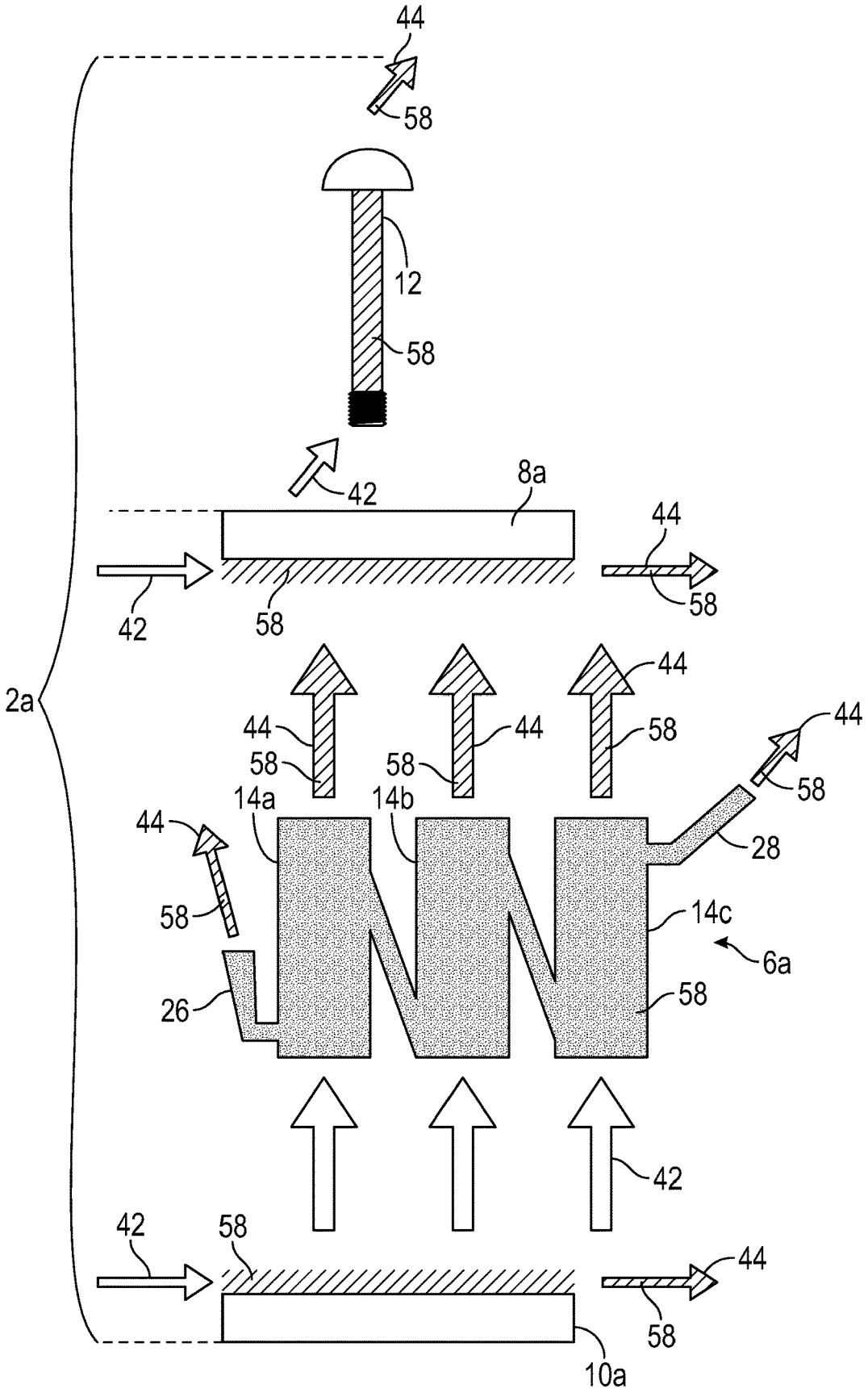
FIG. 6B shows a smoking system as described herein subject to cleaning.
Figure 6C:
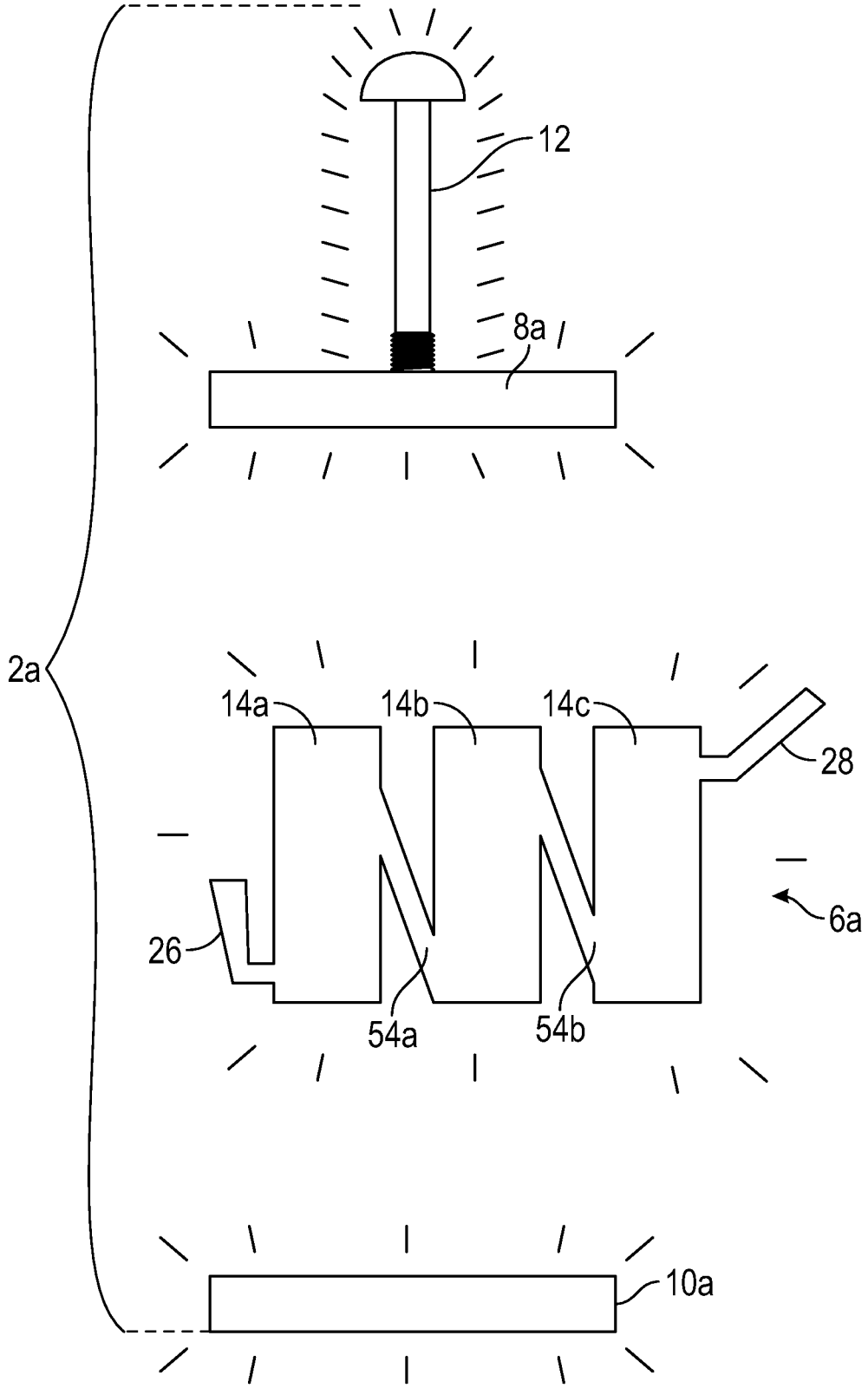
FIG. 6C shows the smoking system of FIG. 6B after cleaning.

FIG. 6B and FIG. 6C illustrate an example of how a smoking system as described herein can be easily disassembled or otherwise disengaged for cleaning, such as for cleaning in a household dishwasher appliance or by hand with a cleaning solution. The smoking system 2*a* shown in FIG. 6A has been used for generating smoke and is dirty such as with particulates, oil, and other unwanted substances in the fluid and on the surfaces. The fastener 12 has been loosened (e.g., unscrewed) and the fastener 12 and cover 8*a* disengaged from the body 6*a* of the system 2*a* shown in FIG. 6A. Used/dirty fluid in the pipes 14 has been dumped out. FIG. 6B shows cover 8*a* and base 10*a* have been disengaged from the body 6*a*. Pipes 14 and conduits 54 have been opened at both ends and can easily be cleaned by flushing a cleaning solution through the pipes and conduits and/or cleaning the pipes and conduits with a brush or another cleaning device configured to enter and clean the insides of the pipes and conduits. Pipes, conduits, recesses, and other components that are stiff may be easier to clean. Pipes, conduits, recesses, and other components may be partially or wholly made of a stiff material such glass, acrylic, metal, or ceramic. Pipes, conduits, recesses, and other components that are stiff may be lined with or otherwise have non-stiff materials (e.g., elastomeric materials) such as at an opening. FIG. 6B shows dirt 58, such as particulates and oil, on the various components of smoking system 2*a*. FIG. 6B shows cleaning solution 42 flowing around and through the components of smoking system 2*a*, including flowing from a first end of the pipes 14 and conduits 54 to a second end of the pipes and conduits, and cleaning the components. Used and dirty cleaning solution 44 is removing dirt 58 from the components. FIG. 6C shows the components from FIG. 6B after cleaning and ready for reassembly and reuse.

Figure 8:
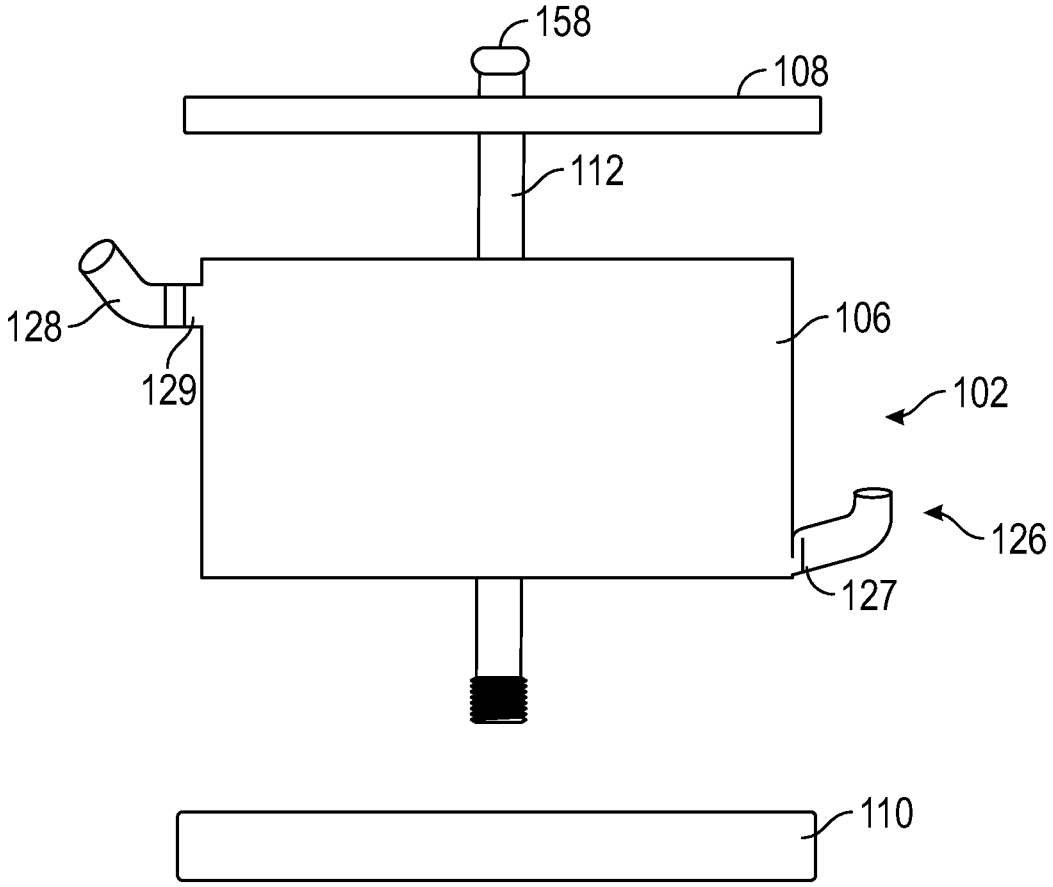
FIG. 8 shows a side view of a nested smoking system with a plurality of easily cleaned chambers. The fastener for attaching the cover and base to the body of the smoking device is visible.
Figure 9:
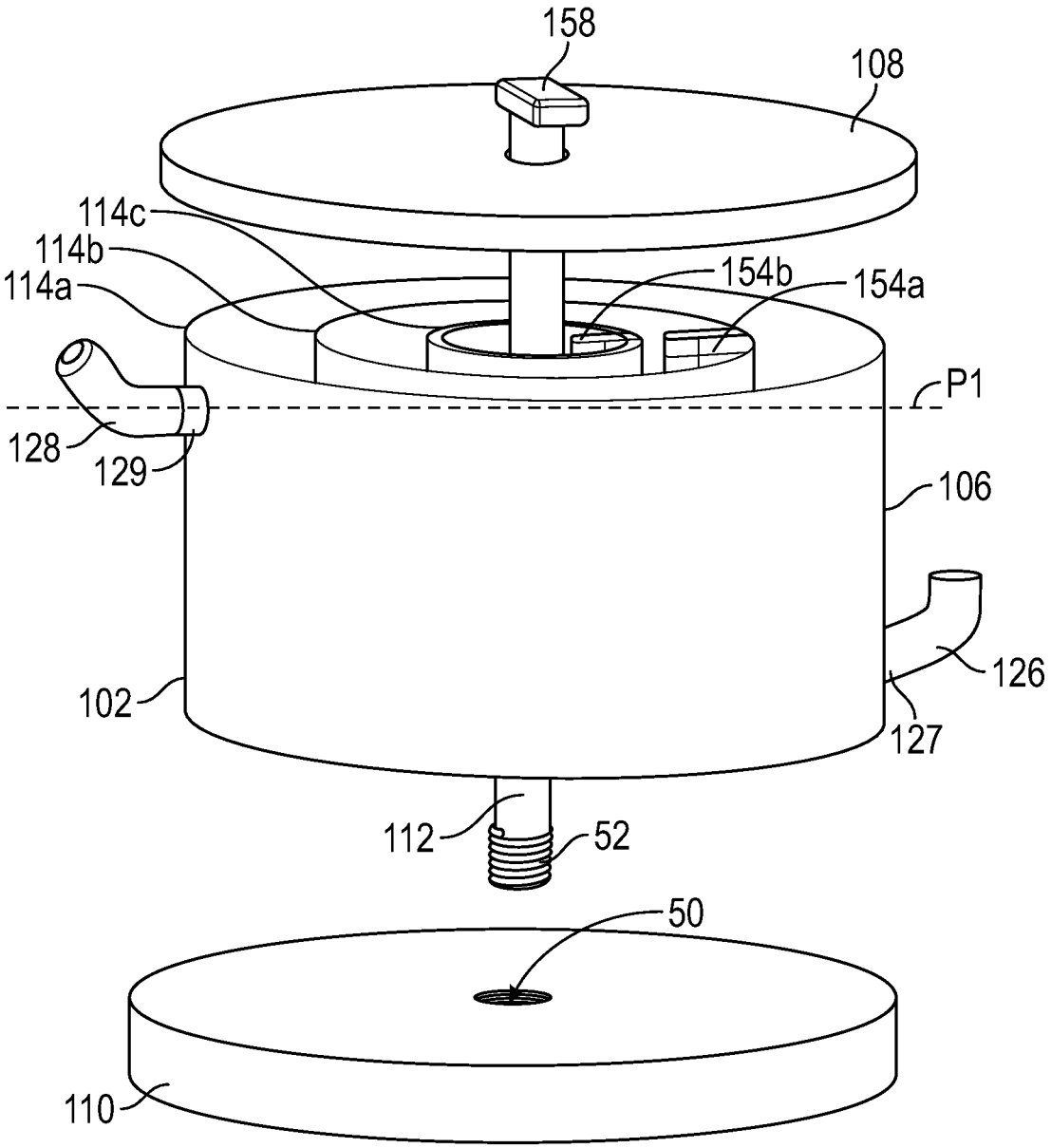
FIG. 9 shows a top-side perspective view of the nested smoking system shown in FIG. 8.
Figure 10A:
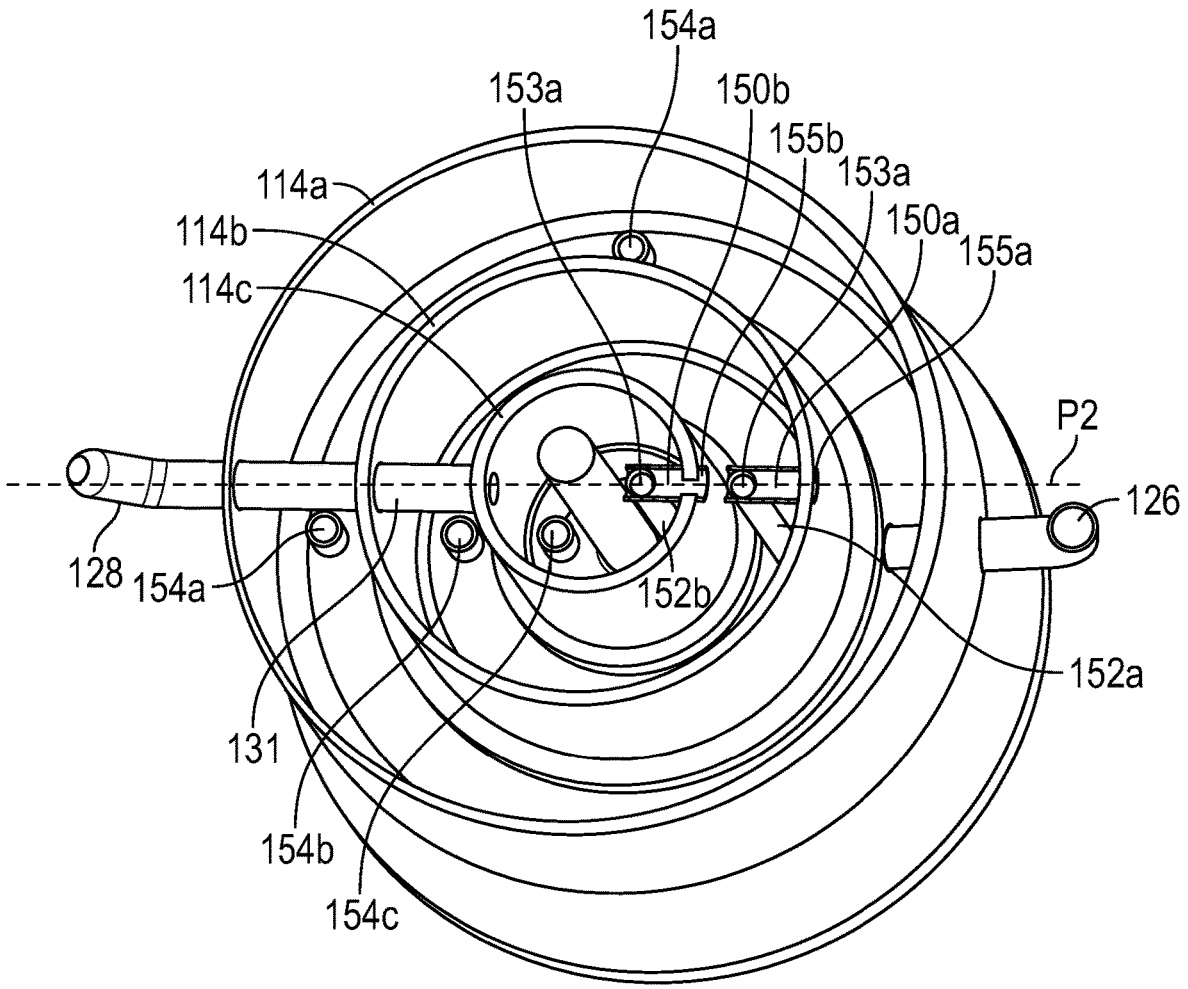
FIG. 10A shows a top perspective view of the smoking system shown in FIG. 9 without a cover.
Figure 10B:
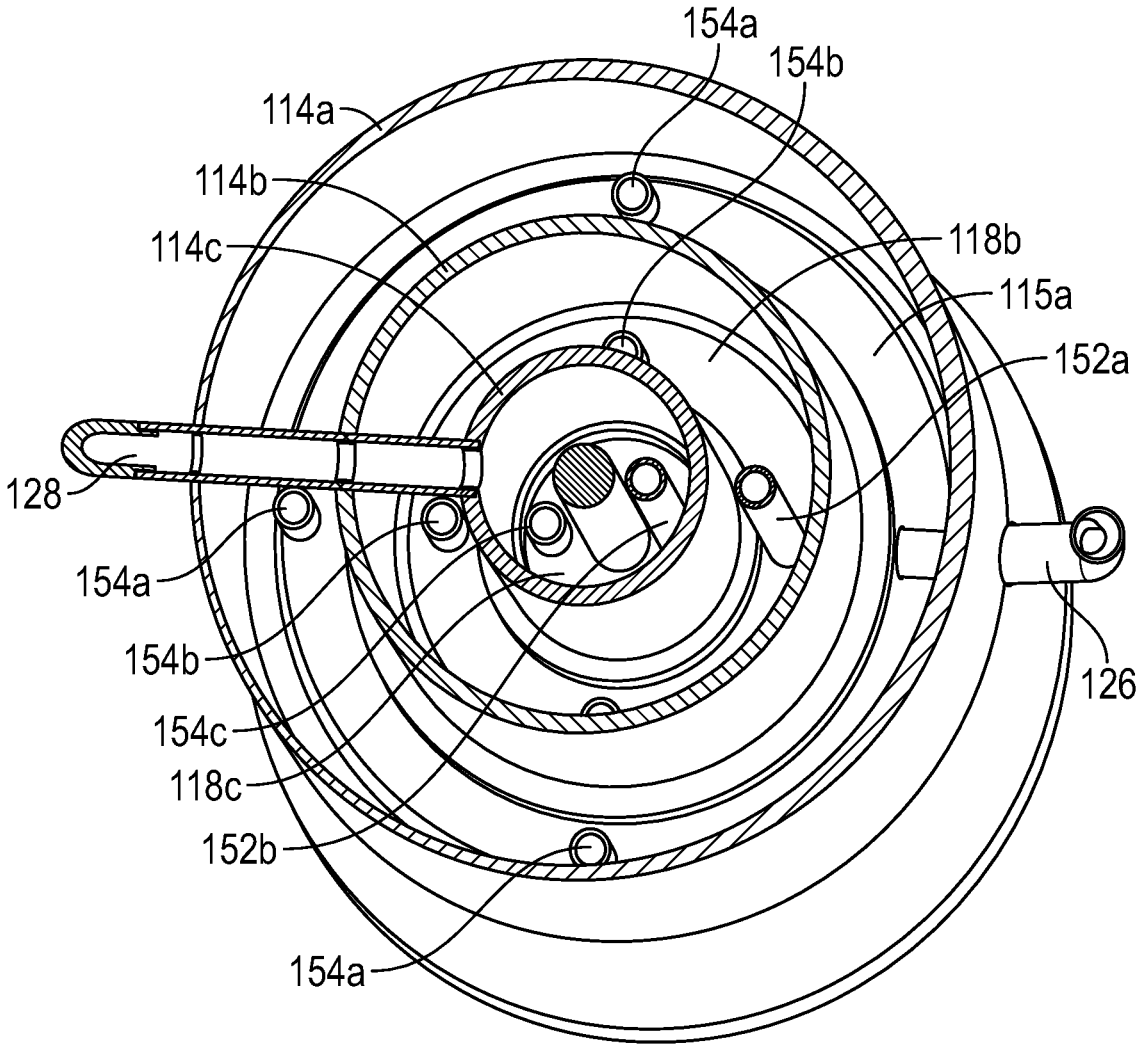
FIG. 10B shows another top perspective view of the smoking system shown in FIG. 9 viewed from partway down the system at the level of the plane P1 shown in FIG. 9.
Figure 11:
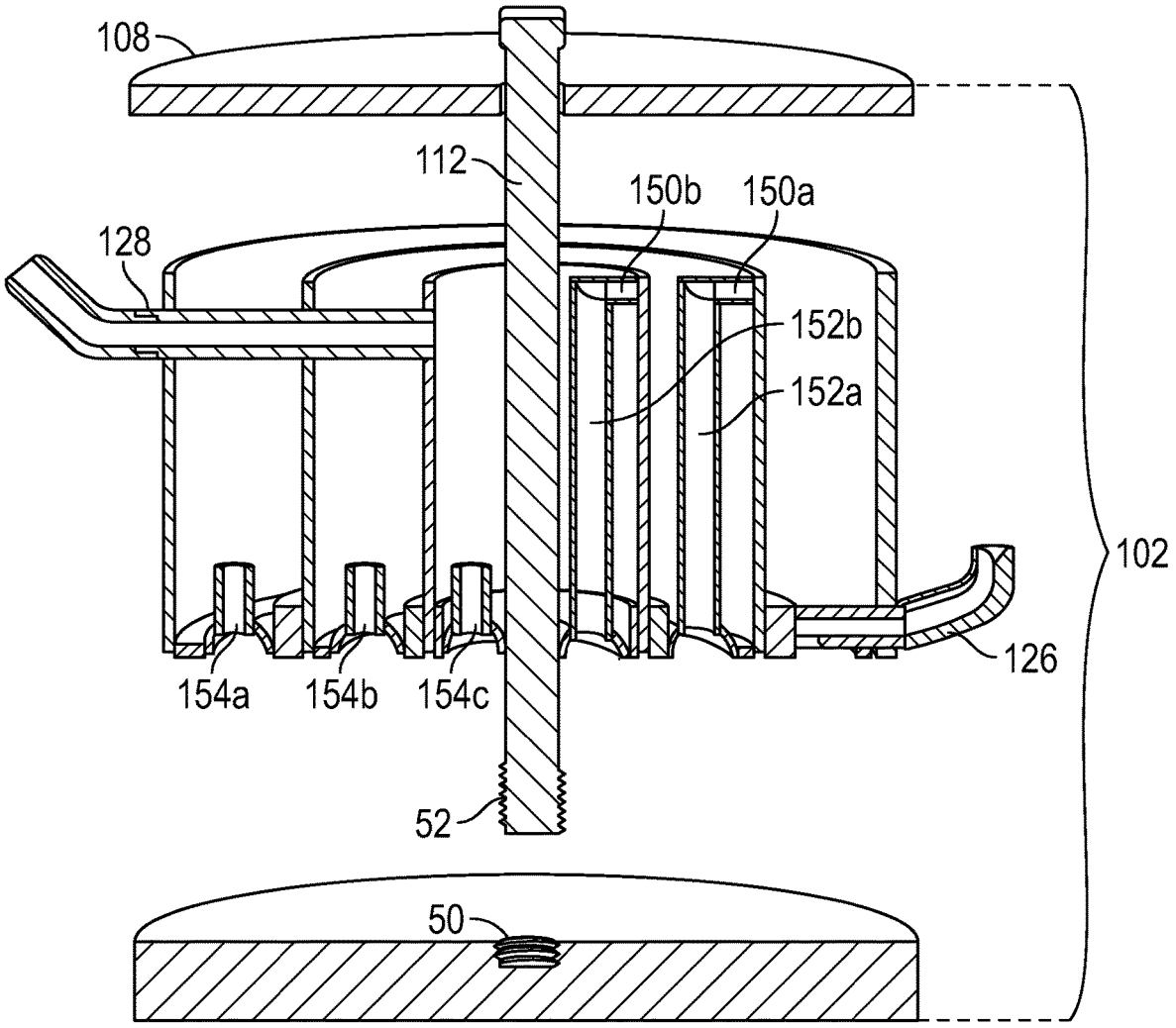
FIG. 11 shows a side perspective view of the smoking system shown in FIG. 9 taken around level of the plane P2 shown in FIG. 10A. The cover, base, and fastener of the smoking system are also depicted.
Figure 12:
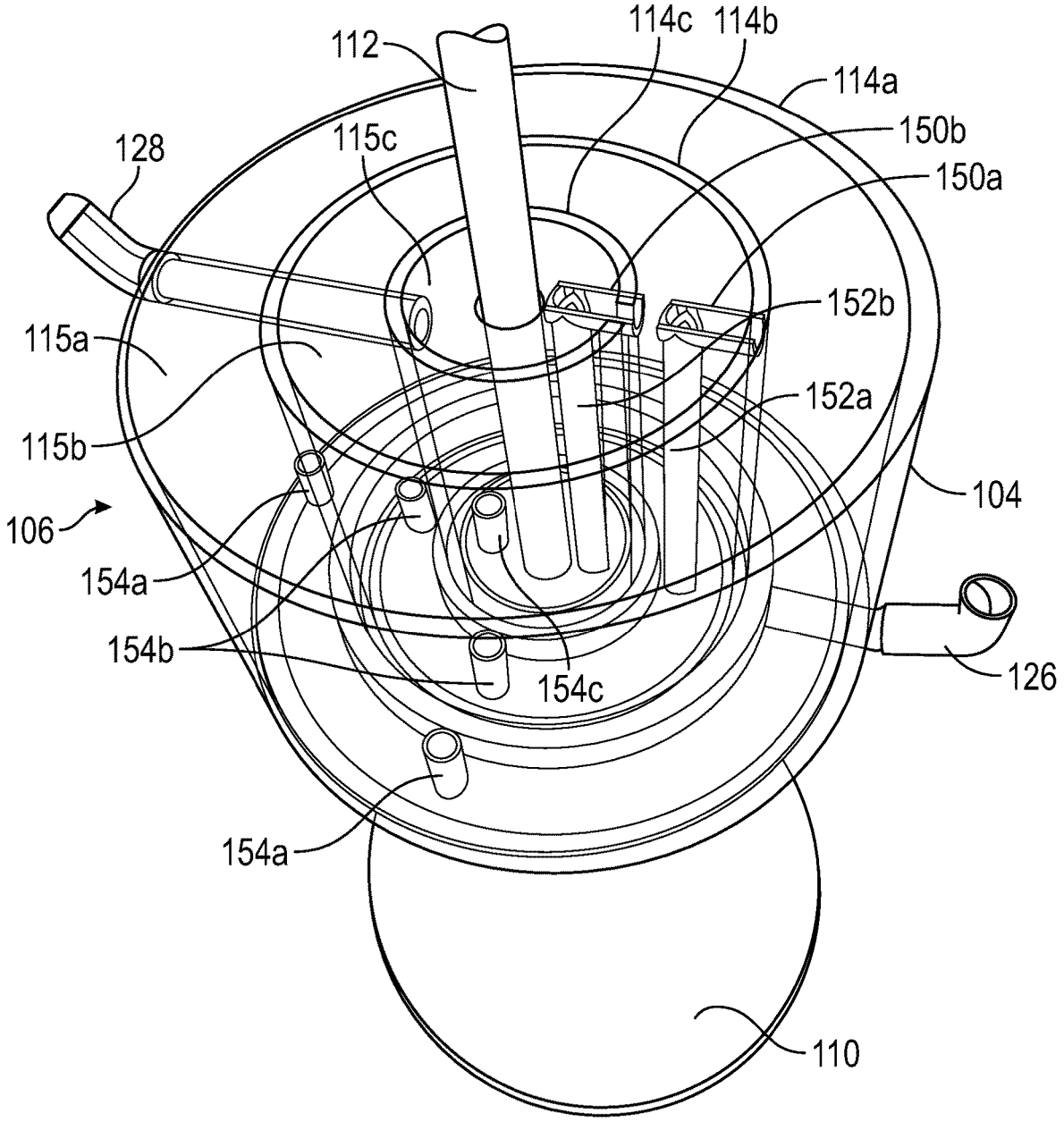
FIG. 12 shows another top-side perspective view of the smoking system shown in FIG. 9. The walls of the nested chambers are partially transparent m to better illustrate the inner structures.
Figure 13:
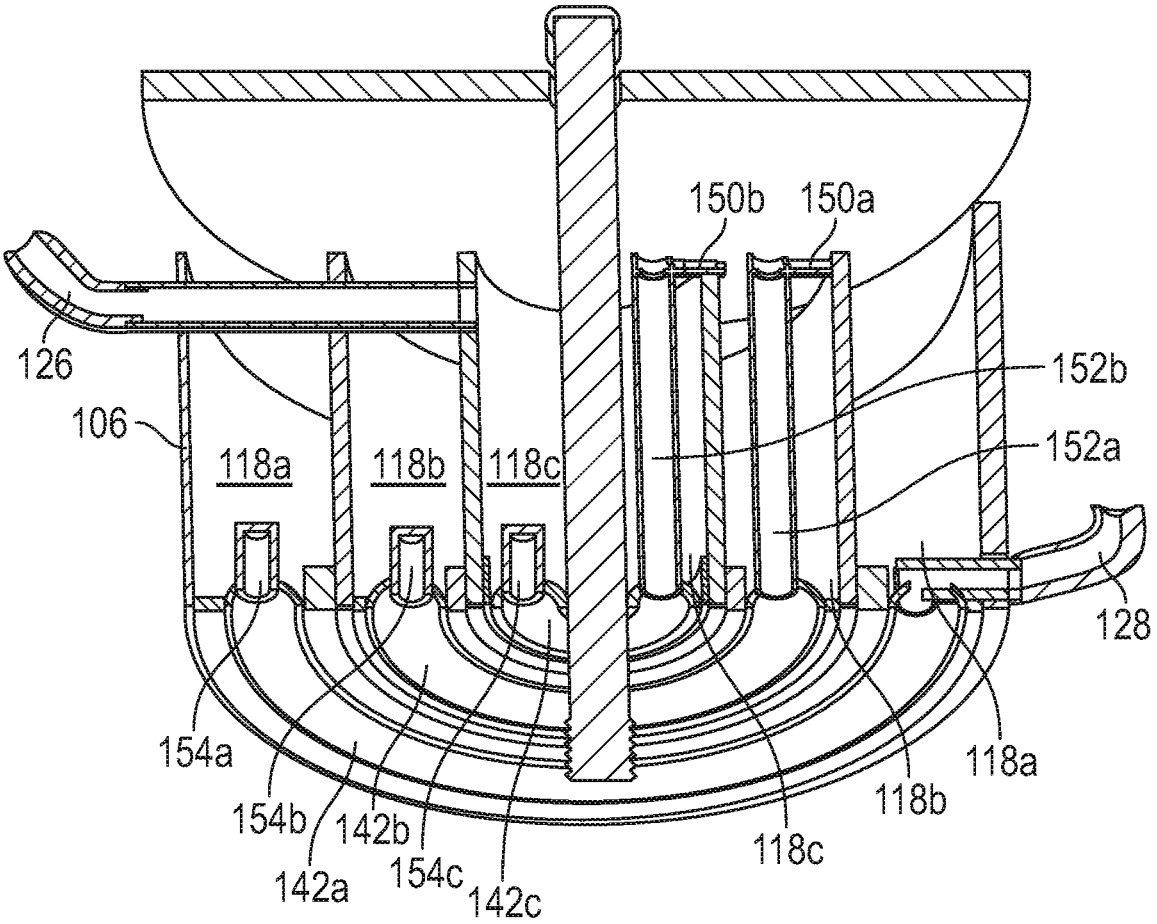
FIG. 13 shows a partial cross-section of the smoking system shown in FIG. 9.
Figure 14:
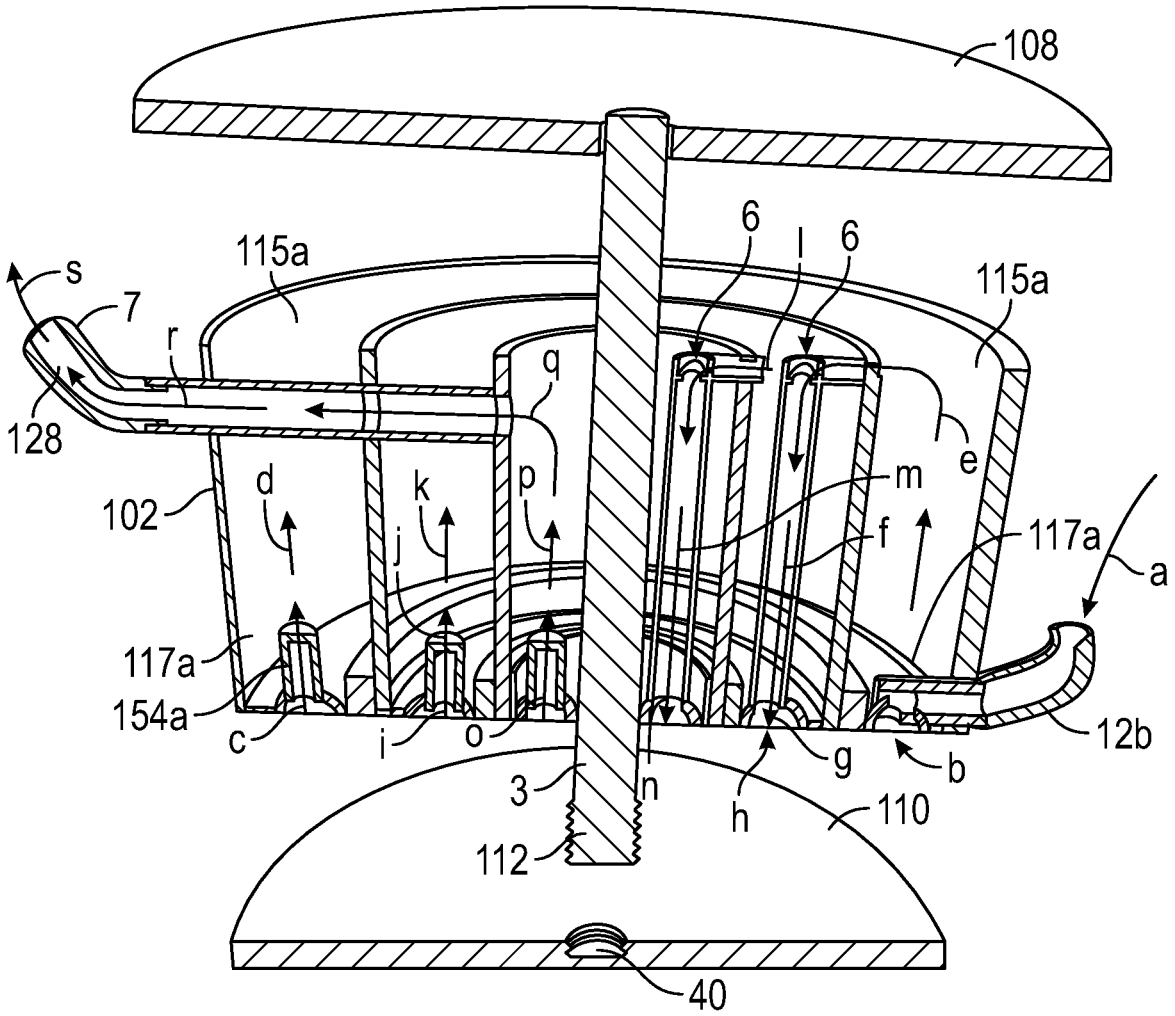
FIG. 14 shows a partial perspective cross-section of the smoking system shown in FIG. 9 and FIG. 10A along the plane P2.
Figure 15:
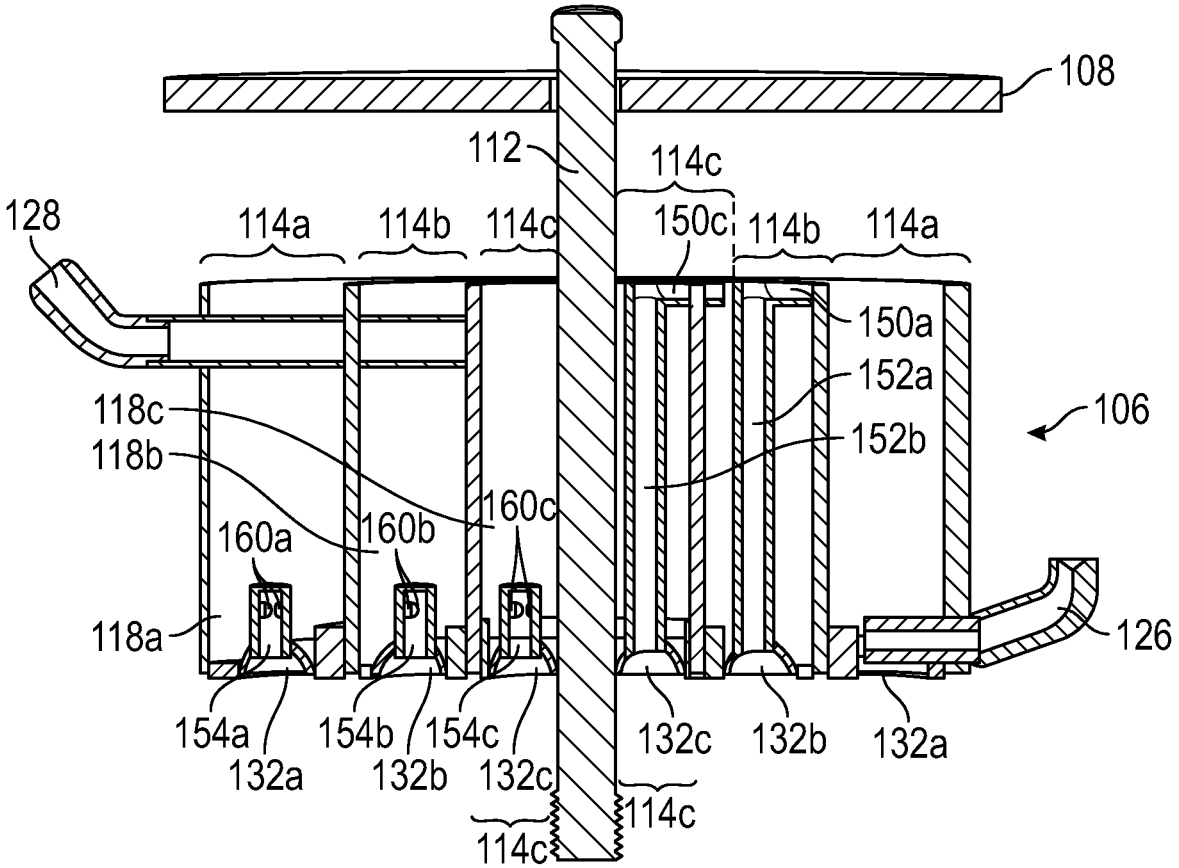
FIG. 15 shows a cross-section of the smoking system shown in FIG. 9 and FIG. 10A along the plane P2.
Figure 16:
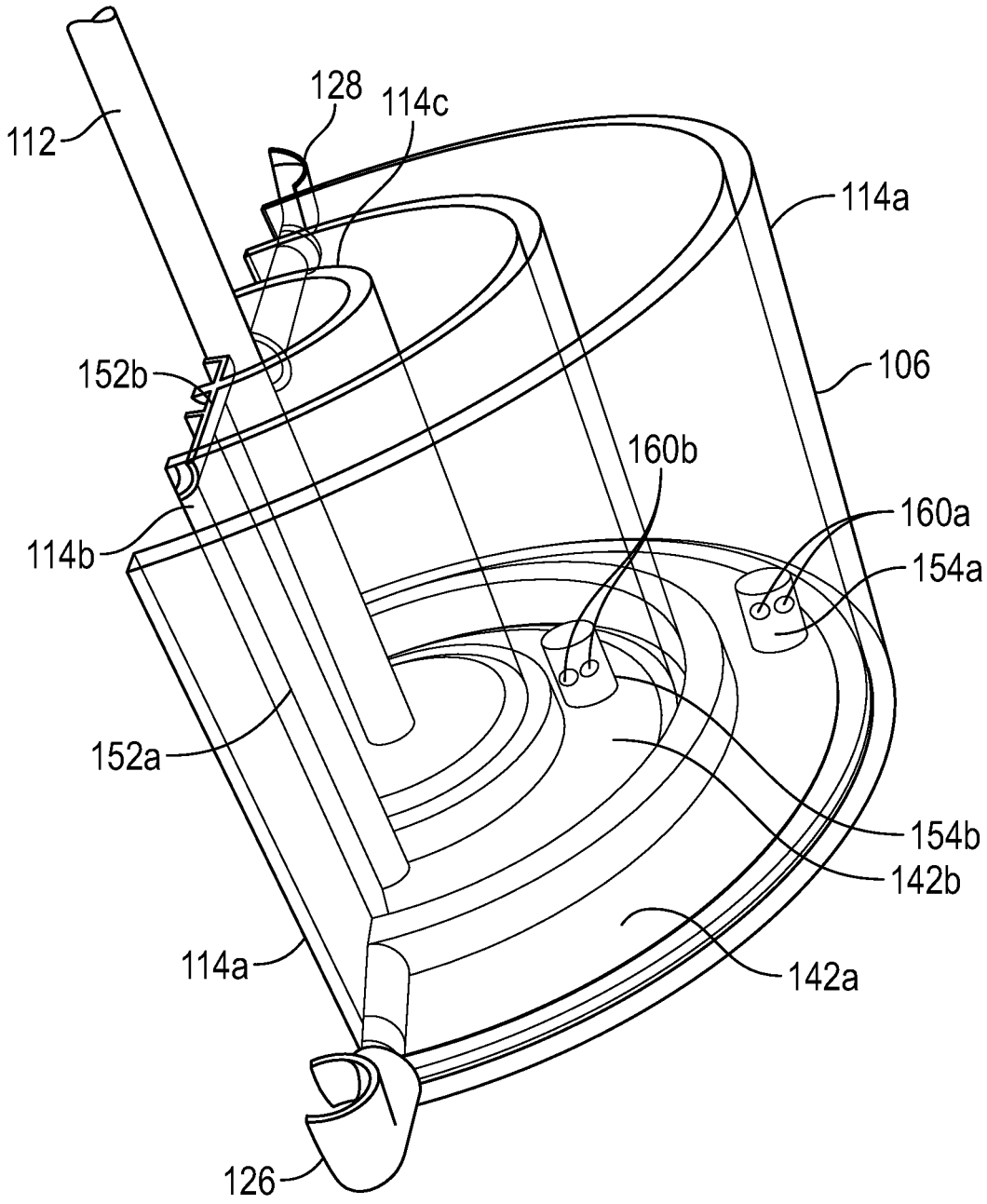
FIG. 16 shows a partial cross-sectional perspective view of the smoking system shown in FIG. 9. The walls of the nested chambers are partially invisible to better illustrate the inner structures.
Figure 17:
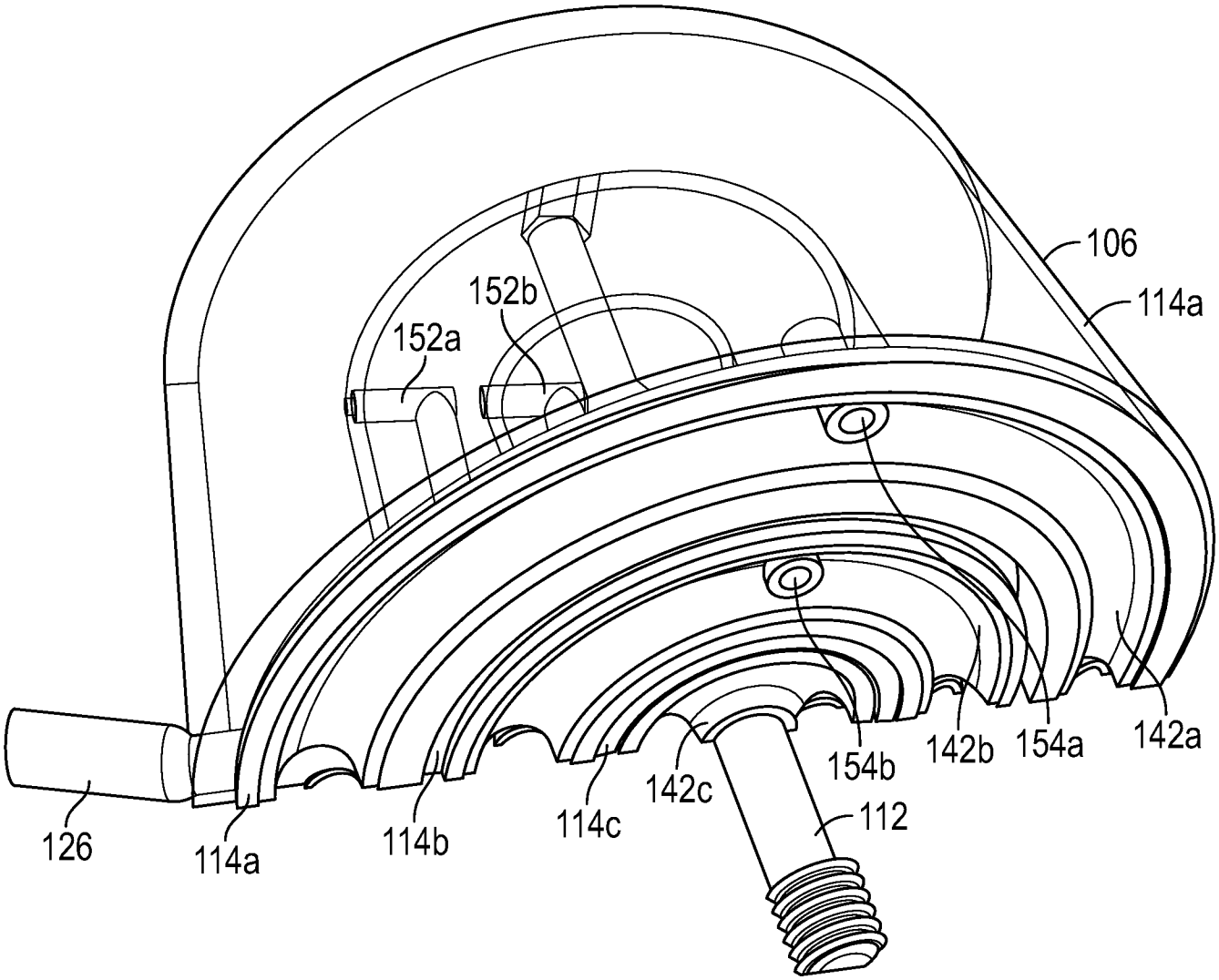
FIG. 17 shows a partial bottom perspective view of the smoking system shown in FIG. 9. The roof of the tunnels is visible on the bottom of the body.
Figure 18:
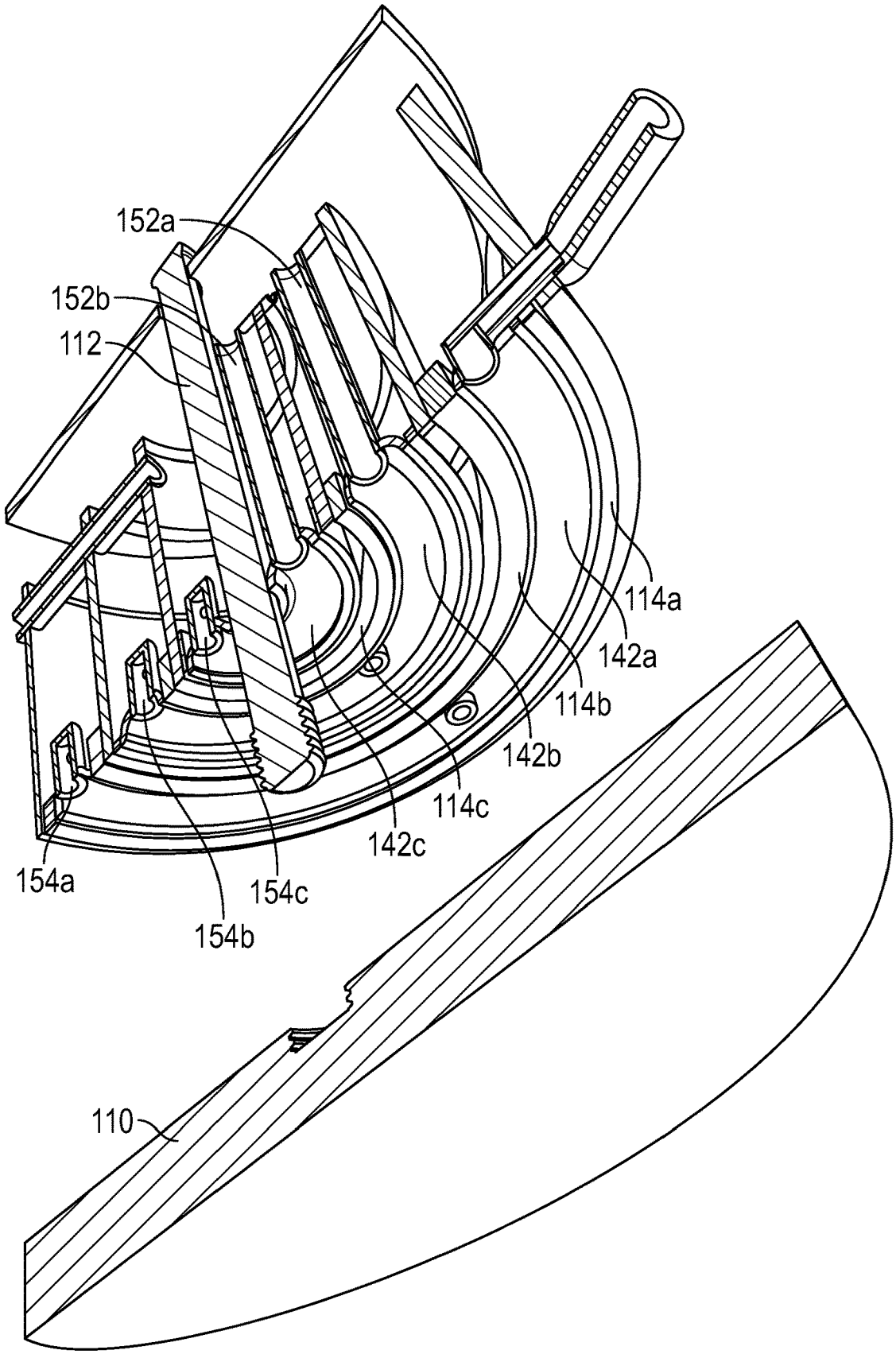
FIG. 18 shows another partial bottom perspective view of the smoking system shown in FIG. 9. The roof of the smoke conducting tunnels is visible on the bottom of the smoking system.
Figure 19:
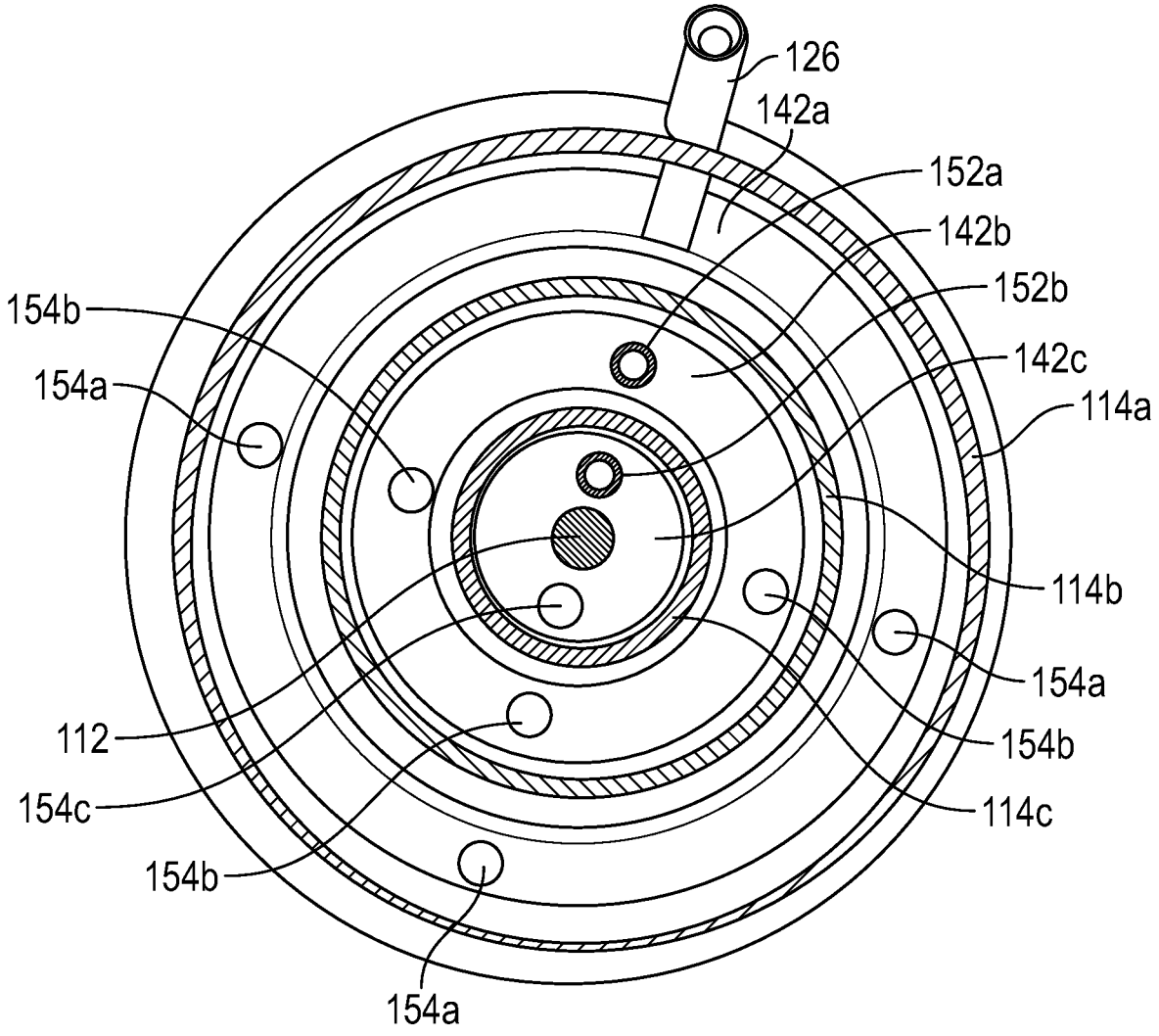
FIG. 19 shows a bottom view of the body of the smoking system shown in FIG. 9. The roof of the tunnels is visible on the bottom of the body.
Figure 20:
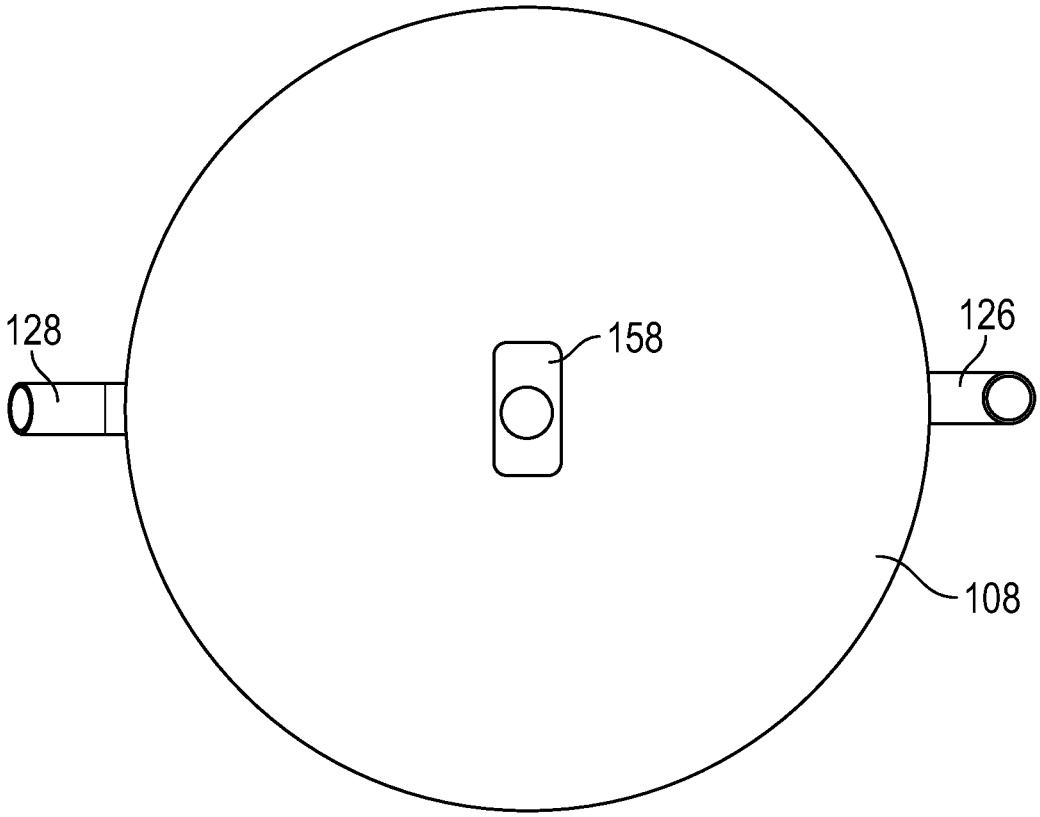
FIG. 20 shows a top view of the smoking system shown in FIG. 9.

FIG. 8 shows a side view and FIG. 9 shows a top-side perspective view of another smoking system 102 with pipes (also referred to herein as sleeves), which are nested pipes. Smoking system 102 has a body 106, cover 108, base 110, and a fastener 112. Smoking system 102 also has a smoke entrance pipe 126 at a smoke inlet port 127 and a smoke exit pipe 128 at a smoke exit port 129. FIG. 9 shows a plurality of nested sleeves 114 (which may sometimes be individually referred to herein as sleeves 114*a*-114*c*). Similar to as described above for the smoking system 2, smoke in smoking system 102 passes successively through a plurality of fluid pools in the pipes (or sleeves) configured to clean and cool the smoke prior to a user using the smoke. In smoking system 102, however, the smoke travels from the top of the sleeves to the bottom of the sleeves and then travels in tunnels at the bottom of the body 106 before being released into a pool of fluid in a chamber of a sleeve. FIG. 10A shows a top perspective view of the smoking system shown in FIG. 9 without a cover and FIG. 10B shows top perspective view of the smoking system similar to the one shown in FIG. 10A, except that the view in FIG. 10B is taken at a level part way down the smoking system 102 and the top part shown in FIG. 10A is cut away. FIG. 10A and FIG. 10B also show a plurality of smoke delivery elements 154 (which may sometimes be individually referred to herein as smoke delivery elements 154*a*-154*c*, with 154*a* referring to smoke delivery elements in sleeve 114*a*, 154*b* referring to smoke delivery elements in sleeve 114*b*, and 154*c* referring to smoke delivery elements in sleeve 114*c*. The smoke delivery elements 154 come up out of the floor of the pipes and are configured to transport smoke from a tunnel at the bottom of the smoking system 102 and to release the smoke into bottom part 118 of chambers in sleeves 114 (e.g., into a fluid pool in the chambers). Smoke delivery elements 154 can be open on the top or have openings 160 on their sides (best seen in FIG. 15 and FIG. 16 and which may sometimes be individually referred to herein as openings 160*a*-160*c*) that open into bottom part 118 of chambers in sleeves 114. FIG. 10A, FIG. 10B, and FIG. 12 show a plurality of smoke delivery elements 154 in each sleeve, though it is not necessary to have multiple smoke delivery elements in each sleeve and each sleeve can have 1, 2, 3, or more than 3 smoke delivery elements. FIG. 11 shows small connectors 150 (which may sometimes be individually referred to herein as small connectors 150*a* and 150*b*) which connect an upper chamber of a sleeve with long tube 152 (which may sometimes be individually referred to herein as long tubes 152*a* and 152*b*). Long tube 152 in turn connects to the tunnels underneath the base. Small connectors 150 and long tubes 152 transport smoke from the upper part of chamber of a sleeve to a tunnel at the bottom of a pipe. Smoke from a tunnel is then transported to a smoke delivery element 154 to deliver the smoke to a fluid pool in a subsequent sleeve. FIG. 14 illustrates the continuous flow path in a smoking system 102 from a to s. Smoke generated from a smoking substance such as in a bowl (not shown in this view) is drawn into smoking inlet pipe 126. Smoke may be drawn in by a user drawing in air at smoking outlet pipe 128 (arrow "a", "b") and creating negative pressure in the continuous flow path. The smoke is drawn into tunnel 132*a* below sleeve 114*a*, traveling through the tunnel to and through smoke delivery element 154*a* ("c") and exits into chamber 115*a* ("d) which contains a first pool of fluid (not shown in this view) for cleaning and cooling the smoke. The smoke travels through the pool of fluid where it is cooled and cleaned and is drawn into the air in the top part of chamber 115*a* above the pool of fluid in chamber 115*a*. The smoke is drawn into and through small connector 150*a* ("e") and down long tube 152*a* ("f"), exits long tube 152*a* ("g"), and into tunnel 132*b* ("h") below sleeve 114*b*. The smoke travels through the tunnel 132*b* ("h") to smoke delivery element ("i") and through smoke delivery element 154*b* ("j") and exits into chamber 115*b* ("k) which contains a second pool of fluid ("k").

The smoke travels through the pool of fluid where it is further cooled and further cleaned. Then the smoke is drawn into the air in chamber 115*b* above the pool of fluid in chamber 115*b*. The smoke is drawn into and through small connector 150*b* ("l") and down long tube 152*b* ("m"), exits long tube 152*b* ("n"), and into tunnel 132*c* ("n") below sleeve 114*c*. The smoke travels through the tunnel 132*c* ("n") to smoke delivery element 154*c* ("o") and through smoke delivery element 154*c* ("p") into the pool of fluid in chamber 115*c* where it is cooled and further cleaned. The smoke travels through the pool of fluid where it is further cooled and cleaned. Then the smoke is drawn into the air in chamber 115*c* above the pool of fluid in chamber 115*c*, exits the chamber 115*c* into smoke exit pipe 128 ("q"), travels through the smoke exit pipe 128 ("r") to a user ("s").

Similar to as described above, smoking system 102 has a continuous flow path from the smoking inlet port 127 to the smoking outlet port 129 and other features as described above also apply here (e.g., materials, numbers of pipes, shapes). In the smoking system 102, the nested pipes (nested sleeves) are different sizes so that they can nest. For example, the smallest sleeve could be 0.5 inches (or smaller) and an outer sleeve could be 6 inches (or larger). In some examples, this and other smoking systems described herein are configured to be handheld. In some variations, a smoking system could be larger, such as for use by multiple users. The components can be arranged in some other ways and still provide a flow path. For example, in some variations, the direction of the flow can be altered from these particulars. Smoke could be deposited into the sleeve 114*c* (the inner sleeve) and removed from smoking system from outer sleeve 114*a*. Other associated components can similarly be rearranged from the arrangement described in FIG. 8 and FIG. 9.

Also described herein are methods of using a smoking system. Some methods of using a system for smoking include generating smoke, passing the smoke through at least two, at least three, or at least four fluid pools in a body of the smoking system, removing the smoke from the smoking system, and delivering the smoke to a user. Some methods include the step of drawing the smoke through at least three, at least four, at least five, at least six, at least seven, at least eight inches of water. Inches of water here refers to the total inches of water including the water from each of the individual fluid pools in a smoking system (e.g., drawing smoke through 4 pools of fluid, each two inches in height is drawing the smoke through eight inches of water). Drawing smoke through more water tends to lead to cleaner smoke (up to a point) but can also make the system large or more difficult to draw on. Generating smoke can refer to using a heat source, such as a charcoal heat source, for heating a substance for generating smoke from the substance. Methods of using a system for smoking include delivering the smoke to a user or inhaling the smoke, such as smoke from a tobacco, *cannabis*, herb, or spice plant, another plant material, or another substance. Some methods of using a system for smoking include drawing air over a heat source such as a charcoal heat source in a body of the smoking system, the body comprising at least three chambers each containing a fluid pool. Some methods of using a system for smoking include creating a negative pressure in a body of the smoking system, the body comprising at least three chambers each containing a fluid pool. Some methods include pulling the smoke into the body using the negative pressure. Some methods include using the negative pressure to deliver the smoke to a user, which may be at the same time as pulling the smoke into the body using the negative pressure. Some methods include delivering the smoke to a user. Some methods include attaching a disengageable base to the body prior to the passing step. Some methods include placing fluid pools into separate chambers of the body. Some methods of a system for smoking include passing smoke through at least three chambers each containing one of the at least three separate pools of fluid and through at least two conduits, the conduits connecting upper and lower portions of different chambers of the plurality of chambers and configured to pass smoke therethrough.

Methods are also disclosed herein for cleaning a smoking system. As indicated above, FIG. 6B-FIG. 6C shows a smoking system as described herein subject to cleaning. After using the system for smoking, such as smoking tobacco, *cannabis*, herbs, spices, or other material, the fluid in the smoking system as well as the smoking system, such as the pipes, cover, base, and bowl, can be dirty with particulates, grime, or oil. Steps for cleaning the smoking system can include disassembling the smoking system, removing the fluid from the system, and passing a cleaning solution along or through various components of the system. Disassembling the smoking system can include disengaging various components of the system such as disengaging the bowl, hose/mouthpiece, fastener, base, and/or cover from the body of the smoking system or disengaging the fastener from the base or cover. In some variations, disassembling the smoking system can include disengaging a smoke entrance pipe such as smoke entrance pipe 26 and a smoke exit pipe such as smoke exit pipe 28 from the body 6 or body 6*a*. The various parts can be completely removed and separated from the body or can remain attached but sufficiently disengaged for cleaning purposes. For example, as explained above, a base or cover could be hinged or tethered to the body so that the base or cover can be sufficiently separated from the body for cleaning purposes. Some examples include removing the cover from the body, and then removing the fluid pools from the body through the open top. Some examples include removing the base from the body, and then removing the fluid pools from the body through the open bottom. Some examples include removing the cover from the body, and then removing the fluid pools from the body through the open cover. The smoking system 2*a* is dirty from use. In FIG. 6B, the dirty fluid pools from the pipes 14 have been removed and the smoking system components cover 8*a*, fastener 12*a*, base 10, and body 6*a* have been disengaged from each other. The components contain dirt 58 and are being subject to cleaning by passing a cleaning solution 42 around and through the components such as around and through the cover 8*a*, fastener 12*a*, base 10*a*, and body 6*a*. The cleaning solution 42 is removing and carrying away dirt from the components as shown by the dirty cleaning solution 44. Some examples include placing the components in a dishwasher machine such as a dishwasher machine found in kitchens and washing the components in the dishwasher machine. Some examples include washing the components by hand. FIG. 6C shows the smoking system 2*a* after cleaning and ready for reassembly and reuse.

In some variations, a smoking system may include a plurality of entrance pipes (and and/or a plurality of exit pipes, and/or a plurality of flow paths, such as for a plurality of users.

Example 1: Smoke was placed in a smoke entrance pipe of the device shown in FIG. 2-FIG. 5 with eight pipes and removed by a negative pressure at a smoke exit pipe. A visually estimated approximately 30% of debris was removed (left behind) in the first pool, approximately 20% removed (left behind) in the second pool, approximately 20% removed (left behind) in the third pool, and approximately 20% removed (left behind) in the fourth pool. No particles were readily visible to the naked eye in the fifth chamber; however small or otherwise visually undetectable particles may also be removed in fifth and additional chambers.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

Throughout this specification and the claims which follow, unless the context requires otherwise, the word "comprise", and variations such as "comprises" and "comprising" means various components can be co-jointly employed in the methods and articles (e.g., compositions and apparatuses including device and methods). For example, the term "comprising" will be understood to imply the inclusion of any stated elements or steps but not the exclusion of any other elements or steps.

In general, any of the apparatuses and methods described herein should be understood to be inclusive, but all or a sub-set of the components and/or steps may alternatively be exclusive, and may be expressed as "consisting of" or alternatively "consisting essentially of" the various components, steps, sub-components or sub-steps.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A system for smoking, the system comprising:

a body comprising:

a plurality of pipes defining a plurality of chambers, each pipe having an open top and an open bottom, and each chamber with an upper portion and a lower portion configured to accept smoke and a fluid;

a plurality of conduits, each conduit connecting the upper portion of the chamber of one pipe to the lower portion of the chamber of an adjacent pipe, each conduit configured to pass smoke therethrough;

a smoke inlet port in a first of the plurality of chambers; and a smoke outlet port in a last of the plurality of chambers, wherein a continuous flow path is formed from the smoke inlet port to the smoke outlet port when a base engages the bottom and a cover engages the top, respectively, of each pipe having an open top and an open bottom.

2. The system of claim 1, wherein the plurality of pipes comprises three pipes.

3. The system of claim 1, wherein each of the plurality of chambers has a height of at least 4 inches.

4. The system of claim 1, further comprising the base.

5. The system of claim 4, wherein the base is configured to engage with and disengage from the bottom of each of the plurality of pipes with an open bottom.

6. The system of claim 1, further comprising the cover.

7. The system of claim 6, wherein the cover is configured to engage with and disengage from the top of each of the plurality of pipes with an open top.

8. The system of claim 6, wherein the cover is configured to sealingly engage with the top of the body and form an airtight seal with the top of each of the plurality of pipes with an open top.

9. The system of claim 6, wherein the cover comprises at least one recess, each recess provided to connect each conduit to an upper portion of each of the plurality of pipes.

10. The system of claim 1, wherein the plurality of conduits comprises three conduits.

11. A system for smoking, the system comprising:

a body comprising:

a plurality of pipes defining a plurality of chambers, each pipe having an open top and an open bottom, and each chamber with an upper portion and a lower portion configured to accept smoke and a fluid;

a plurality of conduits, each conduit connecting the upper portion of the chamber of one pipe to the lower portion of the chamber of an adjacent pipe, each conduit configured to pass smoke therethrough;

a smoke inlet port in a first of the plurality of pipes;

a smoke outlet port in a last of the plurality of pipes; and a base configured to engage with and disengage from the bottom of each of the plurality of pipes with an open bottom and/or a cover configured to engage with and disengage from the top of each of the plurality of pipes with an open top.

12. The system of claim 11, wherein the plurality of pipes comprises three pipes.

13. The system of claim 11, wherein each of the plurality of chambers has a height of at least 4 inches.

14. The system of claim 11, wherein the cover is configured to sealingly engage with the top of the body and form an airtight seal with the top of each of the plurality of pipes with an open top.

15. The system of claim 11, wherein the cover comprises at least one recess, each recess provided to connect each conduit to an upper portion of each of the plurality of pipes.

16. The system of claim 11, further comprising a tether configured to reversibly hold the base and/or cover on the body.

17. The system of claim 11, wherein the plurality of conduits comprises three conduits.

18. A method of smoking comprising:

providing the smoking system of claim 11, wherein the base of the smoking system is attached to the bottom of the body and engaged with the bottom of each of the plurality of pipes with the open bottom, and the cover is attached to the top of the body and engaged with the top of each of the plurality of pipes with the open top such that a continuous flow path is formed from the smoke inlet port to the smoke outlet port;

generating smoke;

conveying the smoke through the smoke inlet port of the smoking system and into a first of the plurality of chambers;

drawing smoke through fluid and an air space in the first chamber;

transferring the smoke to a different of the plurality of chambers and drawing smoke through fluid and an air space in the different chamber; and removing the smoke from the body through the smoke outlet port.

19. The method of claim 18, further comprising, after the transferring step, transferring the smoke to an additional of the plurality of chambers and drawing smoke through fluid and an air space in the additional chamber.

20. The method of claim 18, wherein the plurality of pipes comprises three pipes defining three chambers and the body further comprises a second conduit connecting an upper portion of a second of the three chambers in one of the three pipes to a lower portion of a third of the three chambers in another of the three pipes, wherein the second conduit is configured to pass smoke therethrough from the second of the chambers to the third of the three chambers, wherein passing comprises passing the smoke in the continuous flow path through the first chamber, first conduit, second chamber, second conduit, and third chamber.

* * * * *